US009833057B2

(12) United States Patent
Lyon et al.

(10) Patent No.: US 9,833,057 B2
(45) Date of Patent: Dec. 5, 2017

(54) FLEXIBLE CONTAINER

(71) Applicant: Hydrapak, Inc., Oakland, CA (US)

(72) Inventors: Matthew J. Lyon, Moraga, CA (US); Samuel M. Lopez, San Francisco, CA (US)

(73) Assignee: Hydrapak, Inc., Oakland, CA (US)

( * ) Notice: Subject to any disclaimer, the term of this patent is extended or adjusted under 35 U.S.C. 154(b) by 0 days.

(21) Appl. No.: 15/203,572

(22) Filed: Jul. 6, 2016

(65) Prior Publication Data

US 2016/0309885 A1 Oct. 27, 2016

Related U.S. Application Data

(63) Continuation of application No. 14/480,050, filed on Sep. 8, 2014, now Pat. No. 9,480,323, which is a (Continued)

(51) Int. Cl.

| | |
|---|---|
| ***A45F 3/20*** | (2006.01) |
| ***A45F 3/18*** | (2006.01) |
| ***B31B 1/60*** | (2006.01) |
| ***B31B 1/84*** | (2006.01) |
| ***A45F 5/10*** | (2006.01) |
| ***B65D 47/06*** | (2006.01) |

(Continued)

(52) U.S. Cl.

CPC ..... *A45F 3/18* (2013.01); *A45F 3/20* (2013.01); *A45F 5/10* (2013.01); *B31B 1/60* (2013.01); *B31B 1/84* (2013.01); *B31B 50/60* (2017.08); *B31B 50/84* (2017.08); *B65D 21/086* (2013.01); *B65D 47/06* (2013.01); *A45F 2003/166* (2013.01)

(58) Field of Classification Search

CPC ..... A45F 3/18; A45F 3/20
USPC ..... 215/306, 396; 220/680, 757, 678
See application file for complete search history.

(56) References Cited

U.S. PATENT DOCUMENTS 2,424,188 A * 7/1947 Pearson ..... B65D 7/38 220/680
2,797,023 A * 6/1957 Kaercher ..... B01J 47/02 220/610

(Continued)

FOREIGN PATENT DOCUMENTS

DE 1164171 2/1964
WO WO 2013/134420 9/2013

*Primary Examiner* — King M Chu
(74) *Attorney, Agent, or Firm* — Levine Bagade Han LLP

(57) ABSTRACT

A container for holding and delivering liquids is disclosed. A method of making the same is disclosed. The container can have a molded container top, a molded container bottom, a flexible film reservoir, and a handle extending from the container top to the container bottom. The reservoir can be laterally exposed around the entire circumference of the reservoir along a part of the longitudinal length of the reservoir. A thermally insulated reservoir system is disclosed. The reservoir system can have a bag having a multi-layered bag wall. The bag wall can have a first layer sealed to a second layer. The volume defined between the first layer and the second layer can be partially or completely filled with a fluid insulator, such as air or saline solution. The volume defined between the first layer and the second layer can also or alternately be partially or completely filled with a solid insulator, such as a matted fiber layer.

20 Claims, 37 Drawing Sheets

Related U.S. Application Data continuation of application No. PCT/US2013/029429, filed on Mar. 6, 2013.

(60) Provisional application No. 61/607,507, filed on Mar. 6, 2012, provisional application No. 61/658,562, filed on Jun. 12, 2012, provisional application No. 61/668,918, filed on Jul. 6, 2012.

(51) Int. Cl.

| | |
|---|---|
| ***B65D 21/08*** | (2006.01) |
| ***B31B 50/60*** | (2017.01) |
| ***B31B 50/84*** | (2017.01) |
| *A45F 3/16* | (2006.01) |

(56) References Cited

U.S. PATENT DOCUMENTS

| | | | | |
|---|---|---|---|---|
| 3,411,542 | A | | 11/1968 | Walsh et al. |
| 3,947,307 | A | | 3/1976 | Buchscheidt |
| 4,552,396 | A | | 11/1985 | Rais |
| 4,588,635 | A | | 5/1986 | Donovan |
| 4,681,789 | A | | 7/1987 | Donovan et al. |
| 4,886,674 | A | | 12/1989 | Seward et al. |
| 4,930,644 | A | | 6/1990 | Robbins et al. |
| 4,992,327 | A | | 2/1991 | Donovan et al. |
| 5,043,207 | A | | 8/1991 | Donovan et al. |
| 5,325,982 | A | | 7/1994 | Cobb |
| 5,406,650 | A | | 4/1995 | Einbinder |
| 5,464,106 | A | * | 11/1995 | Slat ..... B29C 49/0073 215/12.1 |
| 5,474,818 | A | | 12/1995 | Ulrich et al. |
| 5,775,812 | A | | 7/1998 | St. Phillips et al. |
| 5,782,561 | A | | 7/1998 | Pai |
| 5,798,166 | A | | 8/1998 | Gross |
| 5,871,119 | A | * | 2/1999 | Blackinton, Jr. .. B65D 83/0061 222/1 |
| 5,971,613 | A | | 10/1999 | Bell |
| 8,007,174 | B2 | | 8/2011 | Yamaguchi et al. |
| 8,043,005 | B2 | | 10/2011 | Lyon et al. |
| 8,251,568 | B2 | | 8/2012 | Burkard |
| 8,568,029 | B2 | | 10/2013 | Kannankeril et al. |
| 8,613,548 | B2 | | 12/2013 | Murray |
| 2002/0036206 | A1 | * | 3/2002 | Bergman ..... B44D 3/12 220/754 |
| 2003/0077010 | A1 | | 4/2003 | Schulz |
| 2004/0026432 | A1 | * | 2/2004 | Matsumura ..... B65D 35/12 220/600 |
| 2005/0072796 | A1 | | 4/2005 | Penfold |
| 2006/0070996 | A1 | * | 4/2006 | Boyle ..... B29C 45/1676 220/254.7 |
| 2007/0047851 | A1 | | 3/2007 | Sato et al. |
| 2007/0211967 | A1 | | 9/2007 | Murray |
| 2007/0217717 | A1 | | 9/2007 | Murray |
| 2007/0280565 | A1 | | 12/2007 | Lyon et al. |
| 2008/0127616 | A1 | | 6/2008 | Matsumura et al. |
| 2010/0282767 | A1 | * | 11/2010 | Wren ..... A47G 23/0216 220/710.5 |
| 2011/0255809 | A1 | | 10/2011 | Tucker et al. |
| 2012/0255262 | A1 | | 10/2012 | Le |
| 2013/0075393 | A1 | | 3/2013 | Haynie |
| 2014/0374413 | A1 | | 12/2014 | Lyon et al. |
| 2014/0376833 | A1 | | 12/2014 | Lyon et al. |

* cited by examiner

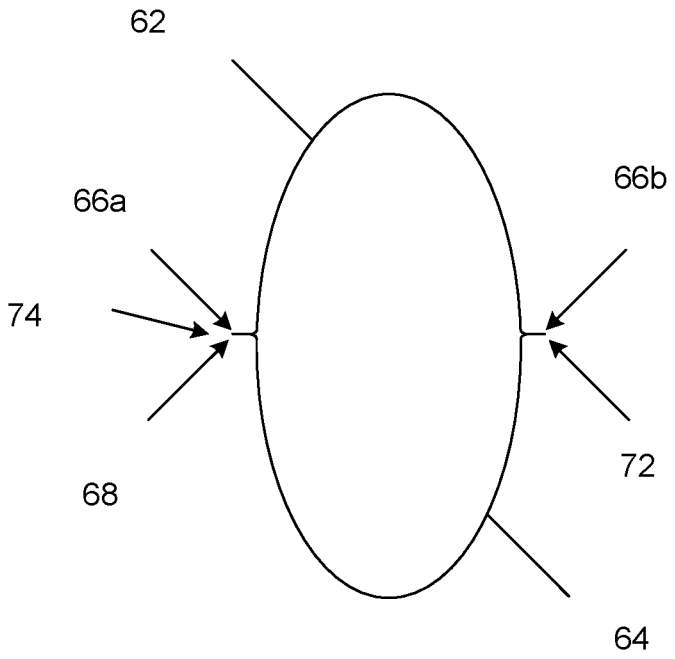
Fig. 11b'-i
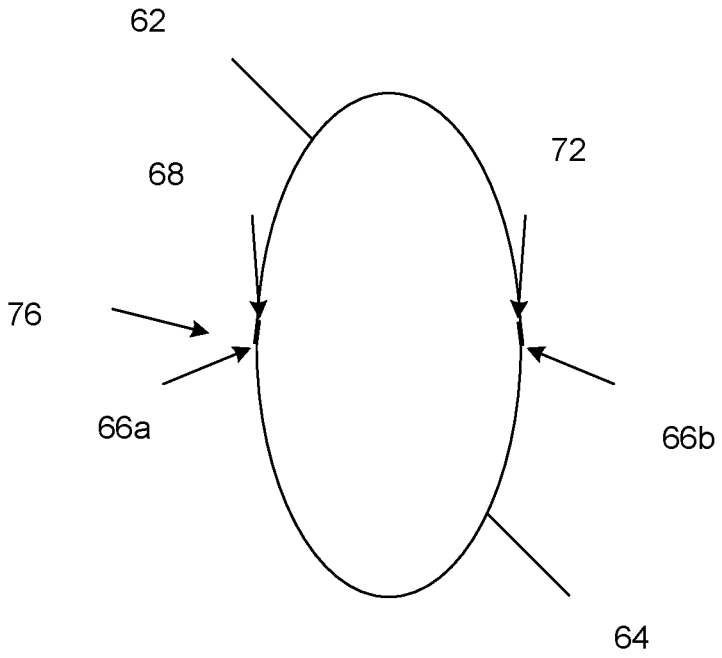
Fig. 11b'-ii

NOT INVENTION

NOT INVENTION

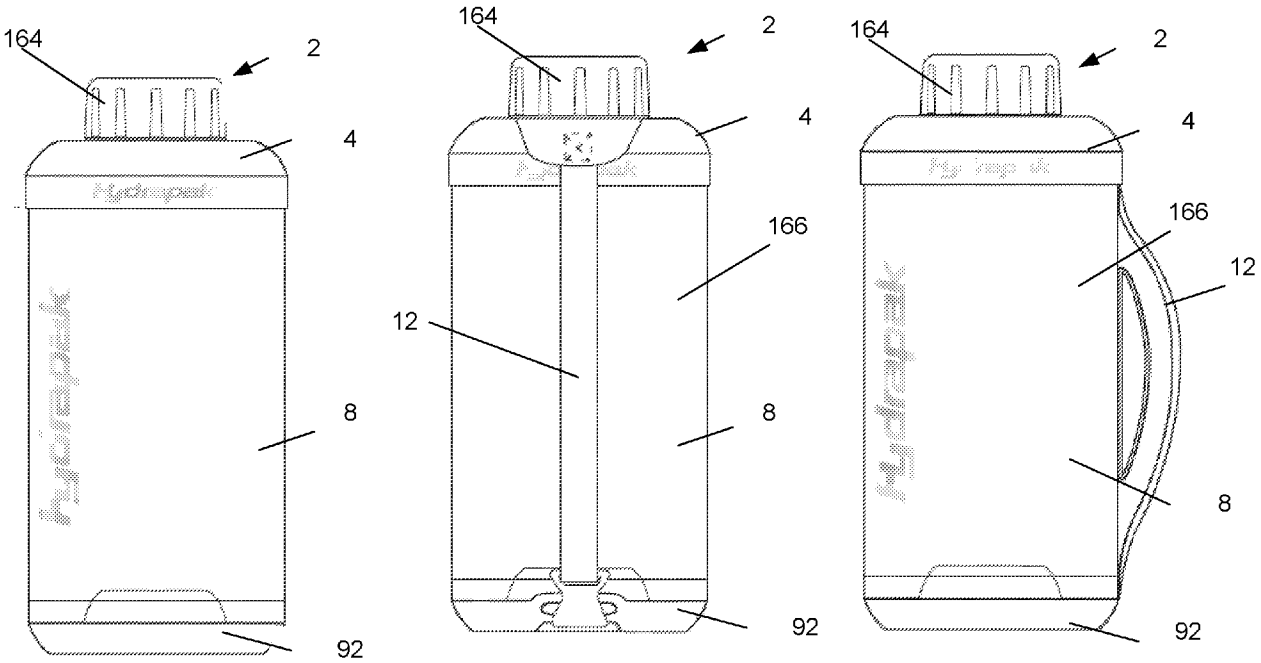
Fig. 38a
Fig. 38b
Fig. 38c
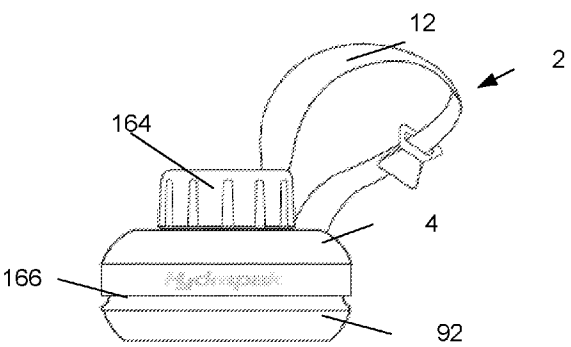
Fig. 39b
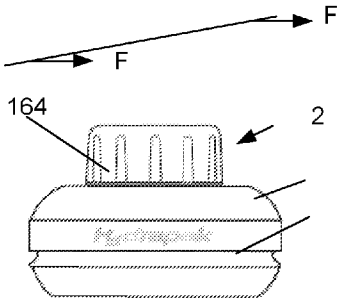
Fig. 39a

FLEXIBLE CONTAINER

CROSS-REFERENCE TO RELATED APPLICATIONS

The present application is a continuation of U.S. patent application Ser. No. 14/480,050, filed on Sep. 8, 2014, which is a continuation of International Application No. PCT/US2013/029429, filed on Mar. 6, 2013, which claims the benefit of U.S. Provisional Application No. 61/607,507, filed on Mar. 6, 2012, U.S. Provisional Application No. 61/658,562, filed on Jun. 12, 2012, and U.S. Provisional Application No. 61/668,918, filed on Jul. 6, 2012, all of which are incorporated by reference herein in their entireties.

BACKGROUND

Existing polyethylene film laminates are welded using heat. Soft reservoir containers sometimes have a molded or rigid part on one end of the reservoir bag. The other end of the bag is closed by sealing the film to itself. It is typical in the art to use polyethylene laminates which are heat welded, not RF welded. The existing bags have gusseted bottoms to stand up—making a standing bag out of a cylinder of material due to folding and welding the film material. The soft reservoirs also often have no handle, and especially not a handle that traverses the length of the reservoir.

Existing recreational liquid reservoir systems are popular for carrying liquids, particularly for personal hydration like water or sports drinks, during outdoor activities, such as hiking and skiing. However, many of the environments are subject to extreme temperature conditions, such as during desert hiking or winter skiing. Yet users would like to keep the liquids at a desirable temperature and also want to prevent freezing. Typical reservoir systems experience freezing and significant heating of the reservoir contents when subject to extreme hot and cold conditions.

Furthermore, there are times when the user wants the environmental temperature to influence and adjust the contents of the reservoir. For example, the user may fill the reservoir with a frozen drinking liquid during a hike hoping the ambient temperature will warm and melt the frozen liquid before the user becomes thirsty. Therefore, in some situations the user may want the reservoir contents thermally insulated and in some situations, the user may want the reservoir contents as thermally uninsulated as possible.

Accordingly, a reservoir system that can maintain the thermally insulate and maintain the temperature of the liquid contents of the reservoir is desired. Furthermore, a reservoir system that can with a removable insulation element is desired.

SUMMARY OF THE INVENTION

A flexible container is disclosed. The container can have a first rigid or semi-rigid, molded element at a first end, such as a container top, and a second rigid or semi-rigid molded element such as a container bottom. The container can have flexible, unmolded reservoir element. The container top can be attached to the top of the reservoir element. The container bottom can be attached to the bottom of the reservoir. The container can have a handle attached to the molded container top and the molded container bottom.

Another variation of a flexible container device is disclosed. The device can have a rigid container top, a rigid container bottom, and a flexible reservoir panel. The reservoir panel can have a first open end and a second open end.

The reservoir panel can be attached at the first open end to the container top. The reservoir can be attached at the second open end to the container bottom. The reservoir panel can be attached to itself.

The reservoir panel can be less flexible than the container top. The reservoir panel can be less flexible than the container bottom.

The device can have a handle extending from the container top to the container bottom. The handle can be unattached to the reservoir. The container top and/or container bottom can be made entirely or partially from a molded plastic. The film reservoir can have a flexible cylinder. The container top can be unattached to the container bottom. The reservoir panel can be exposed to the radial outside of the device. The container top and/or container bottom can be made entirely or partially from a molded polyurethane.

A variation of the flexible container device is disclosed that can have a rigid container top, a reservoir panel having a first end and a second end, a lateral wall extending from the container top, and a handle extending radially from the lateral wall. The reservoir can be attached at a first end to the container top. The lateral wall can have a terminal bottom end that does not cover the bottom of the reservoir panel. The handle can be unattached to the reservoir panel.

The lateral wall can be integrated with the container top. The lateral wall can be integrated with the handle. The lateral wall can be integrated with the handle. The lateral wall can be entirely or partially made from molded polyurethane. The handle can be made entirely or partially from molded polyurethane.

A method of making a flexible container device is disclosed. The method can include forming a seam gap in between a first edge of a flexible reservoir panel and the remainder of the panel, fixedly attaching a rigid container top to an open top of the reservoir panel, fixedly attaching a rigid container bottom to an open bottom of the reservoir panel, and sealing the seam gap of the reservoir panel after fixedly attaching the container top and the container bottom to the reservoir.

The method can include forming a body upper seam and a body lower seam. The seam gap can be between the body upper seam and the body lower seam.

The method can include inserting a welding device into the reservoir through the seam gap. The method can include sealing the container bottom or the container top to the reservoir panel using at least the welding device.

A liquid reservoir system is disclosed. The system can have a bag forming a reservoir. The bag can have a bag wall. The bag wall can have a first layer and a second layer. The first layer and the second layer can be separated by a gap. The bag wall can have a third layer. The third layer can be between the first layer and the second layer.

The first layer can be made from a first material. The second layer can be made from the first material and/or a second material. The third layer can be made from a third material. The third material can be different than the first material and the second material. The third material can have a lower density than the first material and the second material.

The first layer can have a first layer thickness. The second layer can have a second layer thickness. The third layer can have a third layer thickness. The third layer thickness can be larger than the first layer thickness and the second layer thickness. The first layer thickness can be equal to the second layer thickness.

The first layer can be attached to the second layer and/or the third layer. The first layer can be embossed and/or sewn to the second layer and/or the third layer.

The system can have a wall nozzle 198 in fluid communication with a volume between the first layer and the second layer. The system can have a reservoir nozzle 157 in fluid communication with the reservoir. The system can have a detachable sealing member, such as a slider 204 and/or screw top configured to releasably seal the top of the bag.

A method of constructing a liquid reservoir system is disclosed. The method can include forming a bag wall, folding the bag wall, and sealing the bag wall. The forming of the bag wall can include embossing a first layer to a second layer. The bag wall can have a first lateral edge, a second lateral edge, a first bottom edge, and a second bottom edge. The folding of the bag wall can include folding the bag wall at a fold line. The fold line can be laterally between the first lateral edge and the second lateral edge. The sealing of the bag wall can include sealing the first lateral edge to the second lateral edge.

The forming of the bag wall can include embossing the first layer to a third layer wherein the third layer is between the first layer and the second layer. The fold line can be at a lateral middle of the bag wall when the bag wall is in a flattened configuration before folding the bag wall.

A method of using a liquid reservoir system is disclosed. The method can include filling the reservoir with a reservoir fluid. The method can include sliding a sleeve over the bag. The sleeve can have a first layer and a second layer. The first layer can be spaced from the second layer by a gap. The sleeve can have a third layer between the first layer and the second layer. The sleeve can have an insulating fluid between the first layer and the second layer.

BRIEF DESCRIPTION OF THE DRAWINGS

FIG. 1*c* shows a see-through reservoir wall.

FIGS. 11*b*'-*i* and 11*b*'-*ii* are top views of variations of the reservoir lateral wall shown in FIG. 11*b*'.

FIG. 32*a*' illustrates a variation of cross-section E-E of FIG. 32*a*.

FIG. 32*b*' illustrates a variation of cross-section E-E of FIG. 32*b*.

FIGS. 38*a* through 38*c* illustrate variations of the container in an expanded configuration with the reservoir shown as see-through.

FIGS. 39*a* and 39*b* illustrate variations of the container of FIGS. 38*a* and 38*b*, respectively, in a contracted configuration. FIG. 39*a* also illustrates the container of FIG. 38*c* in a contracted configuration with the handle removed from the remainder of the container.

DETAILED DESCRIPTION

Figure 1A:
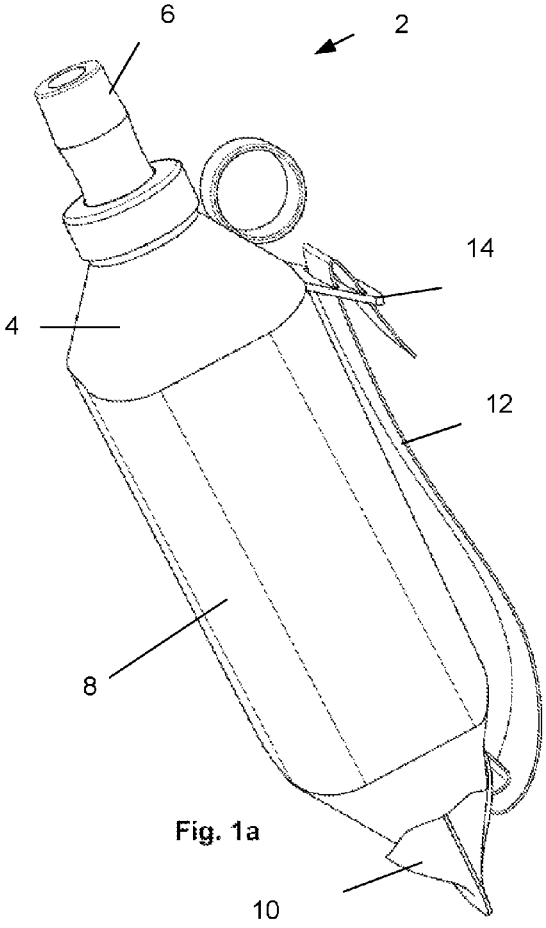
FIGS. 1*a* through 1*f* are side perspective, front perspective, bottom rear perspective, top, front and rear views, respectively, of a variation of the container with the reservoir.
Figure 1B:
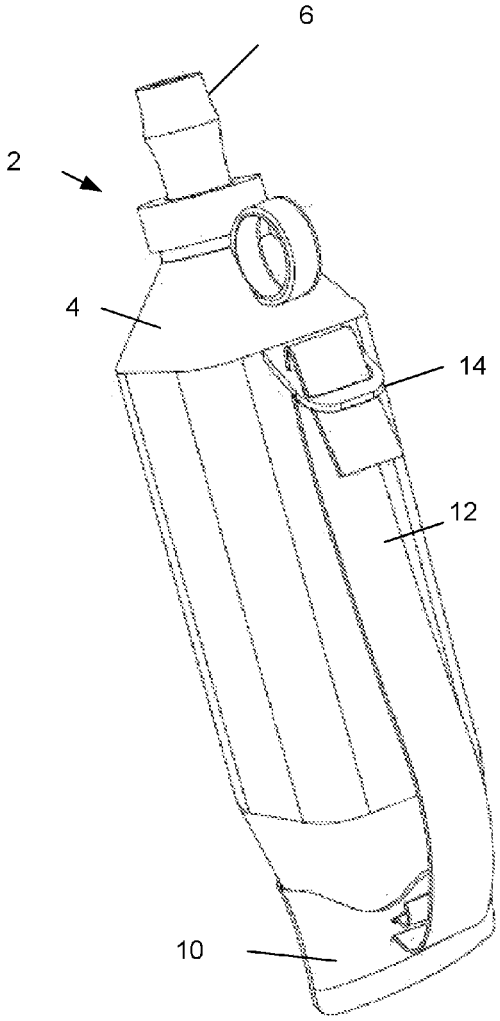
Figure 1C:
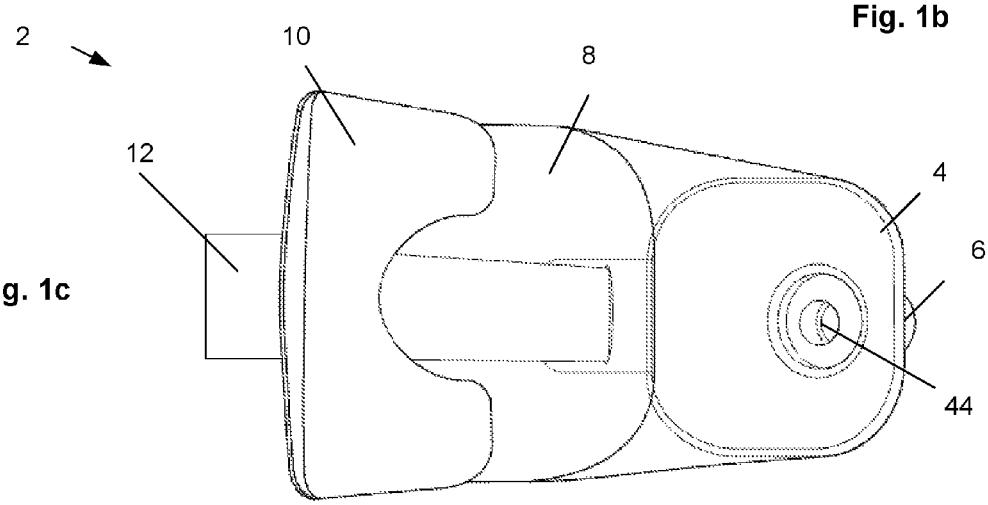
Figure 1D:
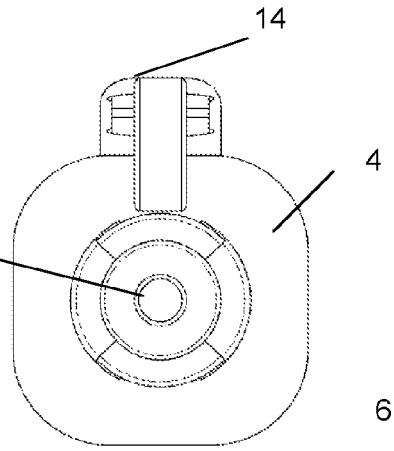
Figure 1E:
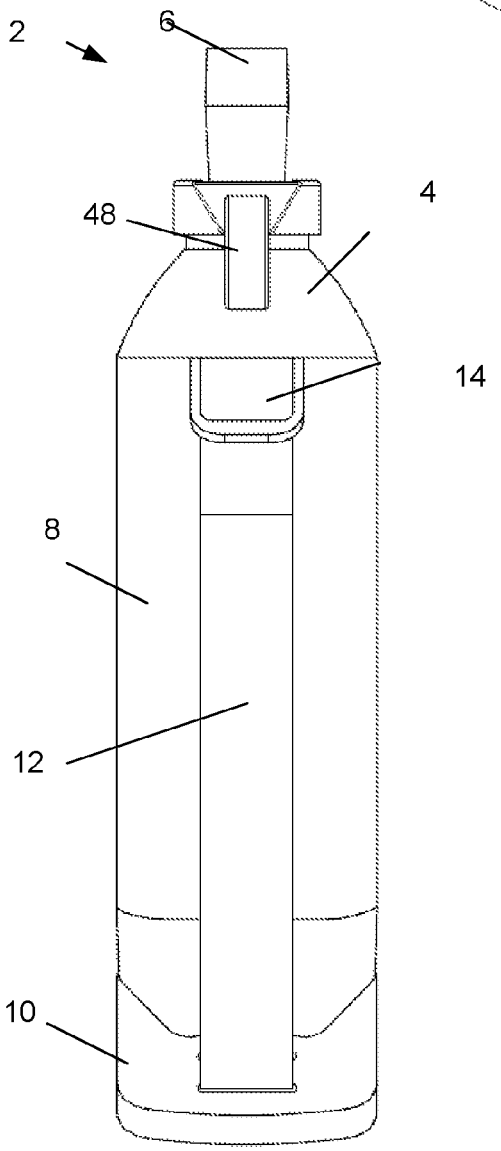
Figure 1F:
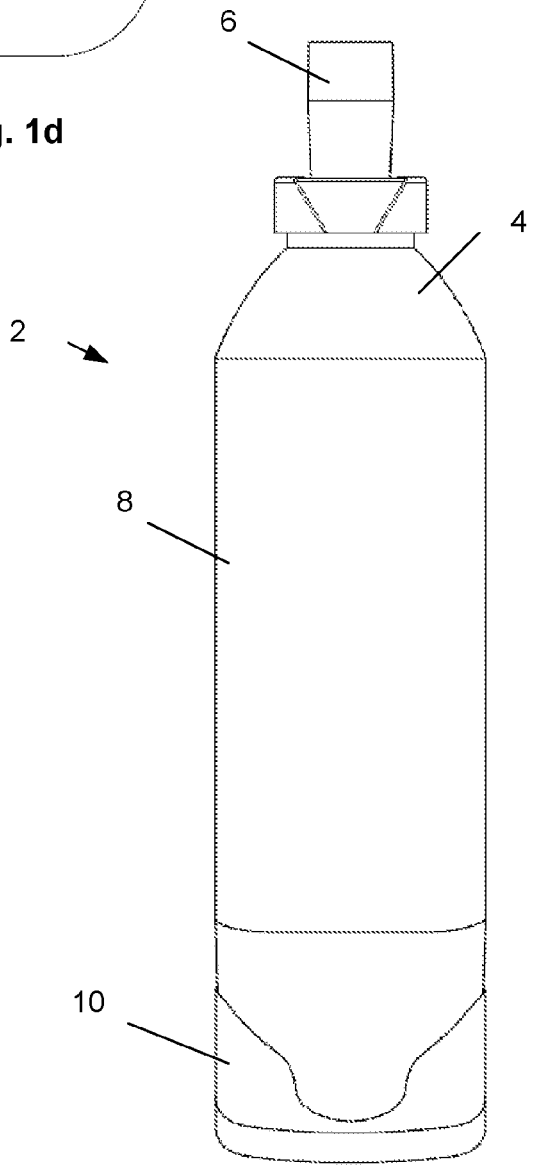

FIGS. 1*a* through 1*f* illustrates a container 2 that can be used for holding, transporting and delivering fluids, for example for drinking.

The container 2 can have a container top 4. The container top 4 can be rigid.

The container top 4 can have a port 44 and/or be attached to a sealing element, such as a removable nozzle 6, spout, valve, or combinations thereof. The container 2 can be filled and emptied of liquid through the port 44 and/or sealing element. The sealing element can have an open configuration and a closed configuration. The sealing element can be screwed or otherwise attached and detached onto and off of the port 44, for example exposing the port 44 through which the container 2 can be filled with or emptied of liquid.

The container 2 can have a reservoir 8 having a bag wall 166 or reservoir wall. The reservoir 8 can be made from soft, flexible TPU (thermoplastic polyurethane) film. The reservoir 8 can be hollow. The reservoir 8 can have a volume such as from about 75 mL to about 25 L, more narrowly from about 100 mL to about 5 L, for example about 500 mL, also for example about 333 mL.

The container 2 can have a container bottom 92. The container bottom 92 can have a bottom cup 10. The bottom cup 10 can be configured to receive the bottom of the reservoir 8.

The container bottom 92 can have a flat bottom terminal end. The flat bottom terminal end can support the reservoir 8, when the reservoir 8 is sufficiently pressurized, to enable the container 2 to stand vertically when placed on a flat surface.

The reservoir 8 can be sealed to itself at the bottom of the reservoir 8 and attached to the bottom cup 10, or the reservoir 8 can be open at the bottom of the reservoir 8 itself, but attached and sealed to the bottom cup 10. The volume of the reservoir 8 can be closed at the bottom of the reservoir 8 by the bottom cup 10. The reservoir 8 can be heat welded and/or RF welded to itself and/or to the container top 4 and the bottom cup 10.

The reservoir 8 can be laterally exposed to the outside of the container 2 around the entire circumference of the reservoir 8 along a part of the longitudinal length of the reservoir 8.

The reservoir 8 can be opaque, transparent, translucent, or combinations thereof.

The container 2 can have a handle. The handle 12 can traverse the length of the reservoir 8. The handle 12 can extend from the container top 4 to the container bottom 92. The handle 12 can be unattached to the reservoir 8.

The handle 12 can be hard, rigid, flexible, or combinations thereof. The handle 12 can have one or more fabric webbings (e.g., backpack webbings), straps, slings, or combinations thereof. The handle 12 can extend from the container top 4. The handle 12 can terminate before or extend to the container bottom 92. The handle 12 can be adjustable for length at the container top 4 and/or the container bottom 92.

The handle 12 can be fixed or detachable to the container top 4 and/or container bottom 92. The handle 12 can be removed from the container 2 and repositioned, replaced, or left off the container 2.

The top and bottom molded parts can securely and fixedly attach to the handle 12.

Figure 2:
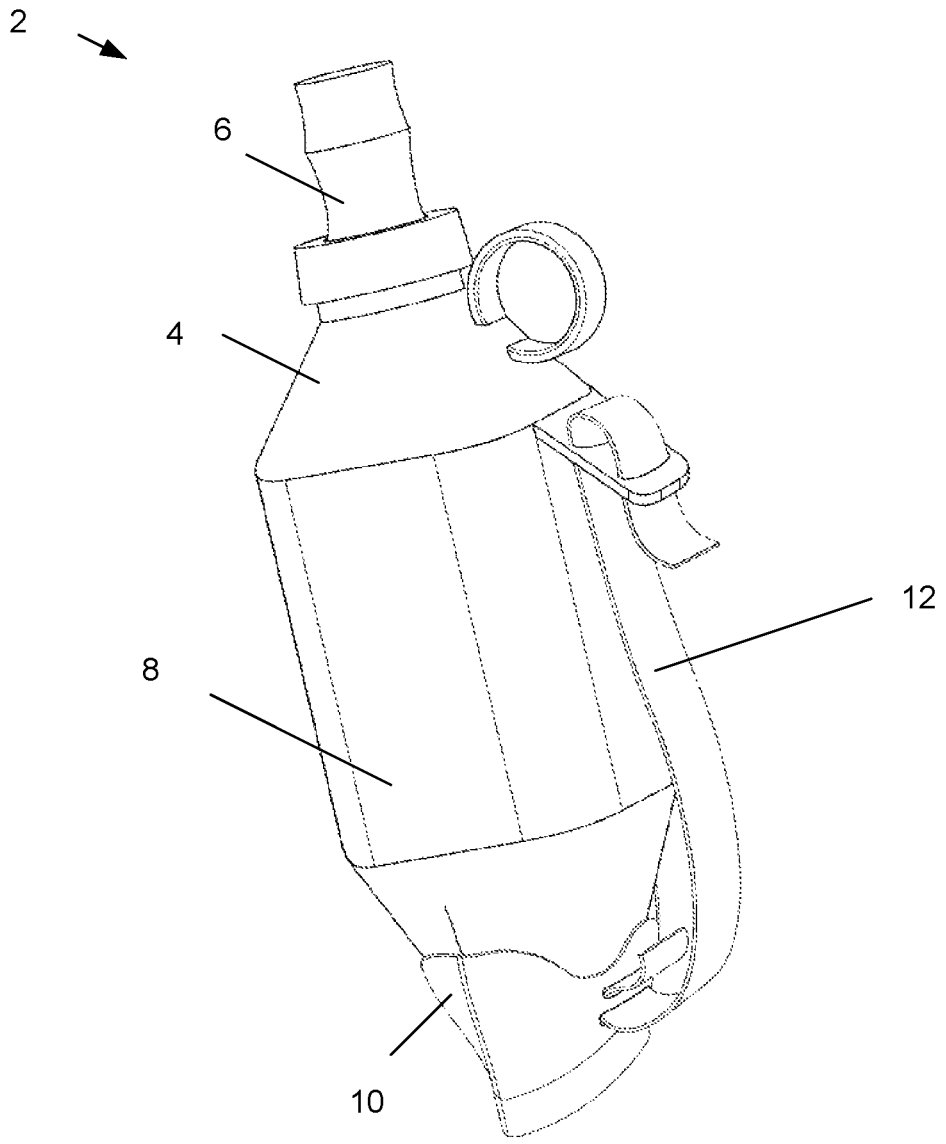
FIG. 2 illustrates a variation of the container.

FIG. 2 illustrates that the reservoir 8 can larger or smaller than the reservoir 8 shown in of FIGS. 1*a* through 1*f*. For example, the reservoir 8 can have a volume of about 333 ml.

FIGS. 3*a* through 3*g* illustrate a variation of the container 2 shown without the handle 12 for illustrative purposes.

Figure 4:
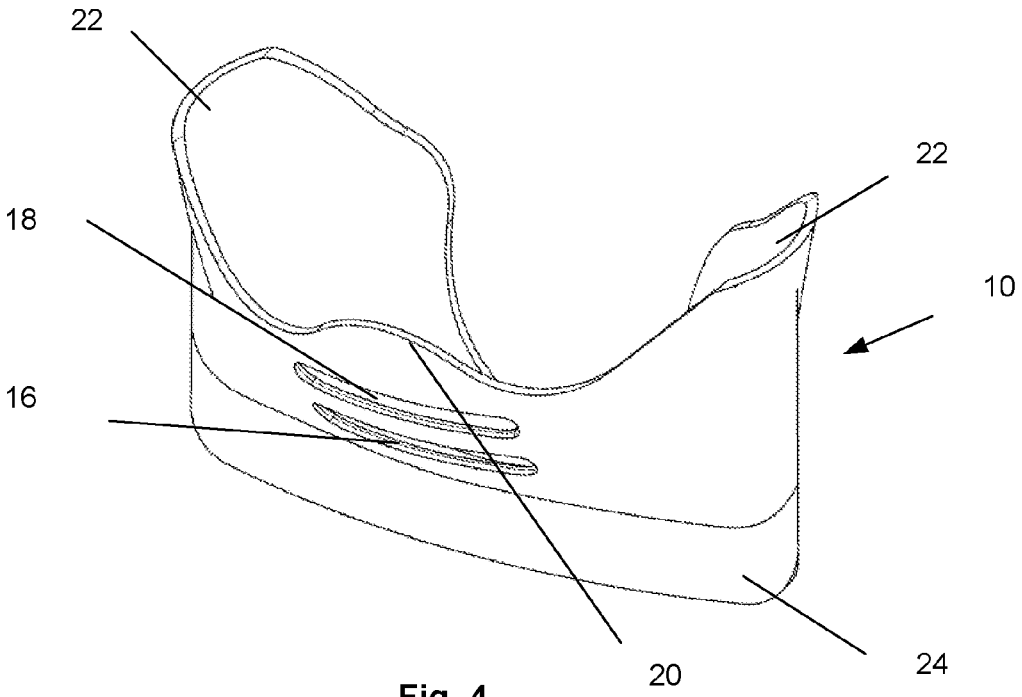
FIG. 4 illustrates a variation of the bottom cup.

FIG. 4 illustrates that the bottom cup 10 can have a handle bottom lower slot 16 and a handle bottom upper slot 18. The bottom upper and lower slots can be elongated apertures or slits. The handle 12, such as a flexible strap, can be fed through the handle bottom lower slot 16 and into the handle bottom upper slot 18. The length of the exposed handle 12 can be adjusted by pushing more length of the handle 12 into or out of the bottom lower and upper slots.

The bottom cup 10 can have a handle guard 20. The handle guard 20 can rise above the surrounding perimeter of the bottom cup 10 in the direct vicinity of the handle bottom slots 36, for example to protect the reservoir 8 from rubbing against the handle 12.

The bottom cup 10 can have laterally opposed cup hips 22. The cup hips 22 can rise above the surrounding perimeter of the bottom cup 10.

The container bottom 92 can have a bottom stand 24 at the bottom terminal end. For example, the bottom stand 24 can have a flat bottom side.

Figure 5:
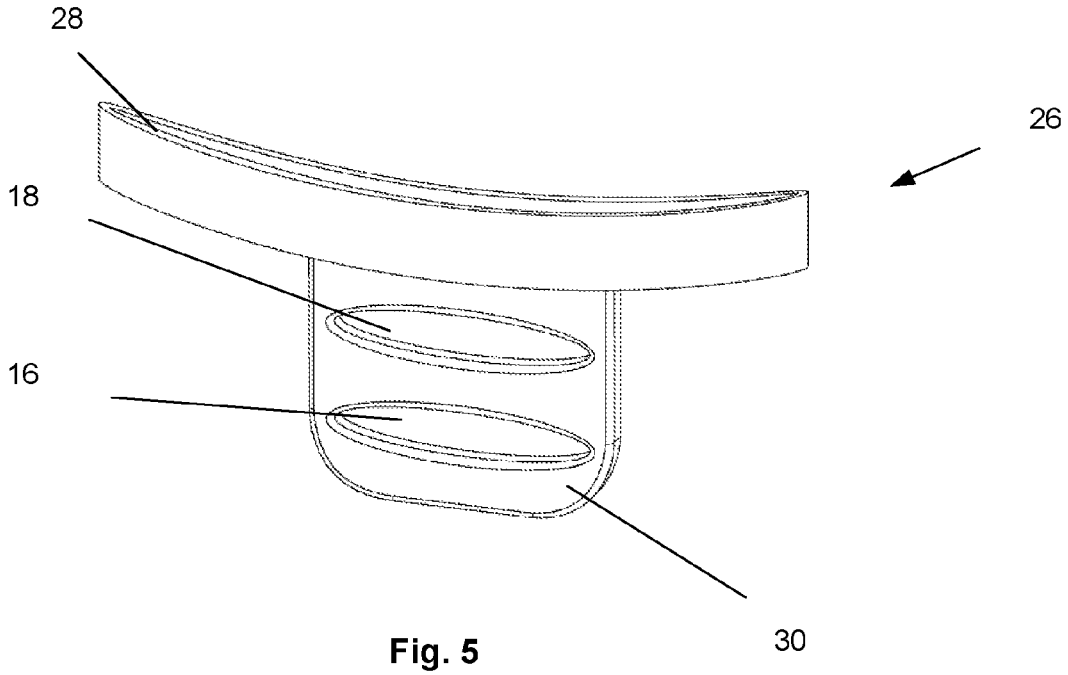
FIG. 5 illustrates a variation of the bottom handle adjuster.

FIG. 5 illustrates that the bottom handle adjuster 26 can have a bottom handle adjuster frame 28 and a bottom handle adjust tab extending upward or downward from the front, rear or center of the bottom handle adjuster frame 28. The bottom handle adjust tab can have the handle bottom lower slot 16 and the handle bottom upper slot 18. The bottom handle adjuster frame 28 can be attached to the bottom cup 10. The bottom handle adjuster frame 28 can be detachable or fixedly attached to the bottom cup 10.

Figure 6:
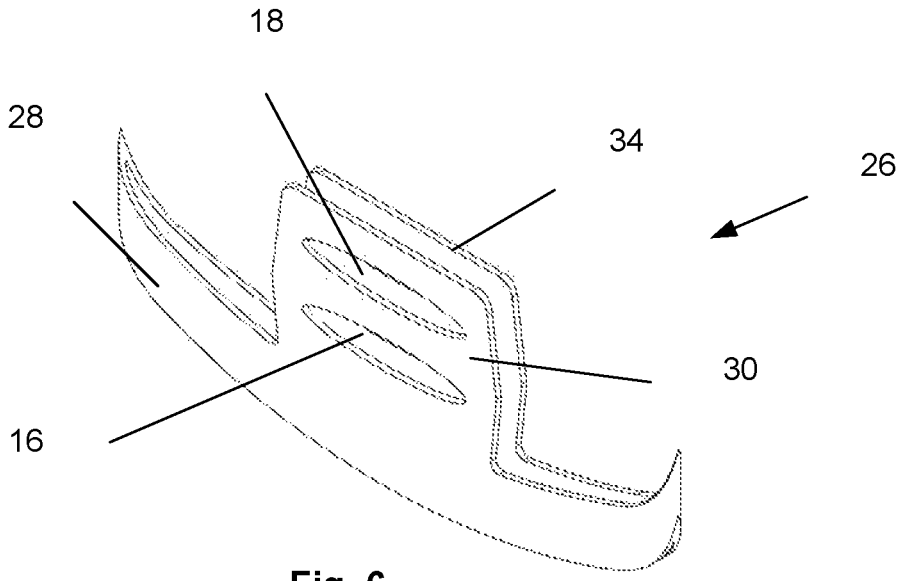
FIG. 6 illustrates a variation of the bottom handle adjuster.

FIG. 6 illustrates that the bottom handle adjuster 26 can have a bottom handle adjuster front tab 32 extending upward or downward from the front of the bottom handle adjuster frame 28, and/or a bottom handle adjuster rear tab 34 extending upward or downward from the rear frame. The bottom handle adjuster front tab 32 and/or the bottom handle adjuster rear tab 34 can have a handle bottom upper slot 18 and a handle bottom lower slot 16.

Figure 7:
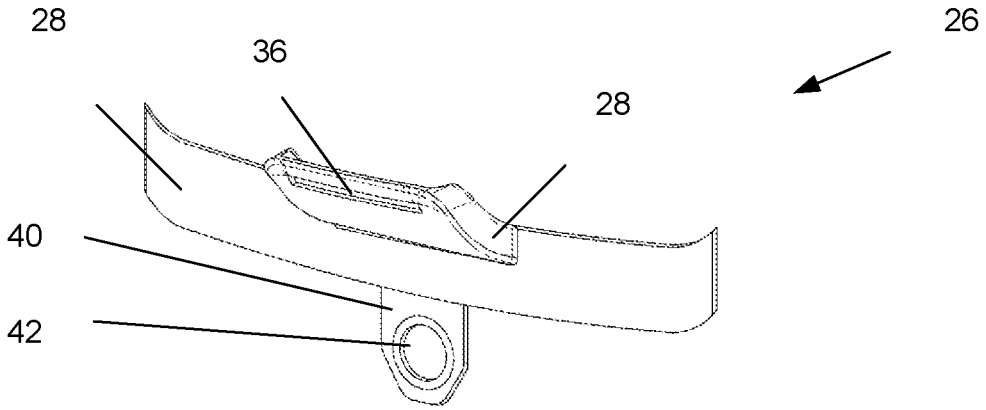
FIG. 7 illustrates a variation of the bottom handle adjuster.

FIG. 7 illustrates that the bottom handle adjuster 26 can have a planar bottom handle adjuster frame 28. The bottom handle adjuster tab 30 can extend forward or rearward from the bottom handle adjuster frame 28. The bottom handle adjuster tab 30 can have a single handle bottom slot 36.

Figure 3A:
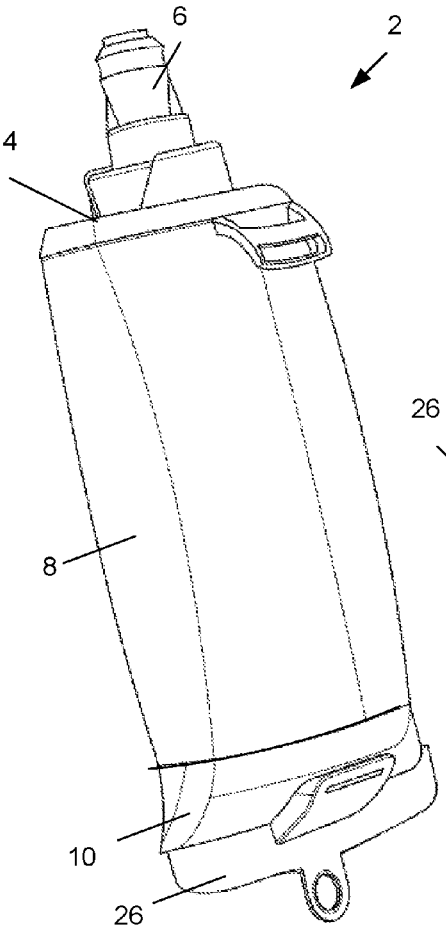
FIGS. 3*a* through 3*g* are front side perspective, bottom rear perspective, top rear perspective, side, front, bottom and top views, respectively, of a variation of the container shown without a handle.
Figure 3B:
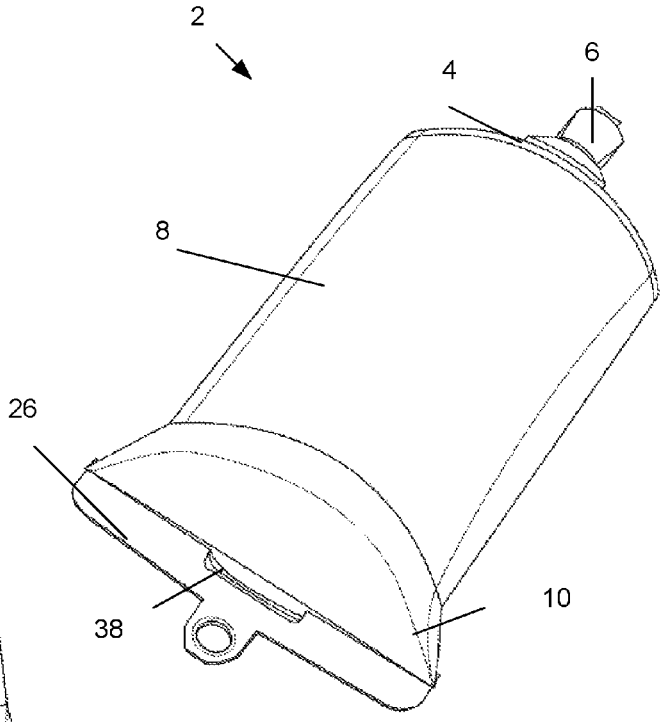
Figure 3C:
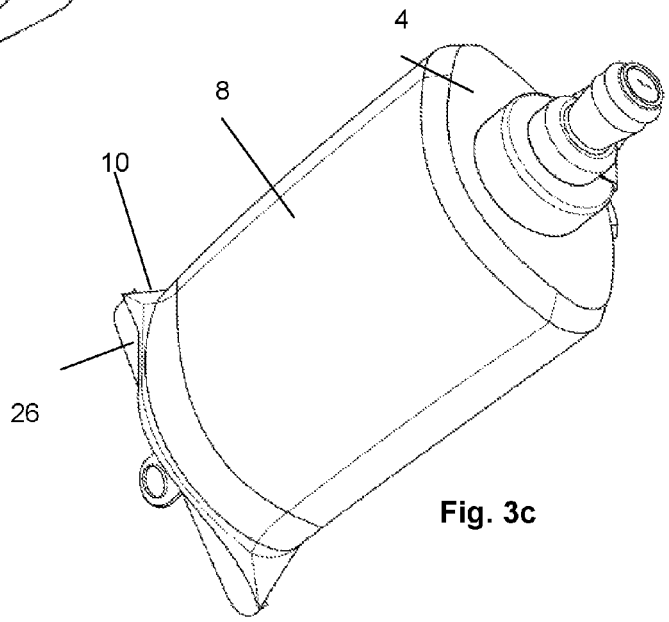
Figure 3D:
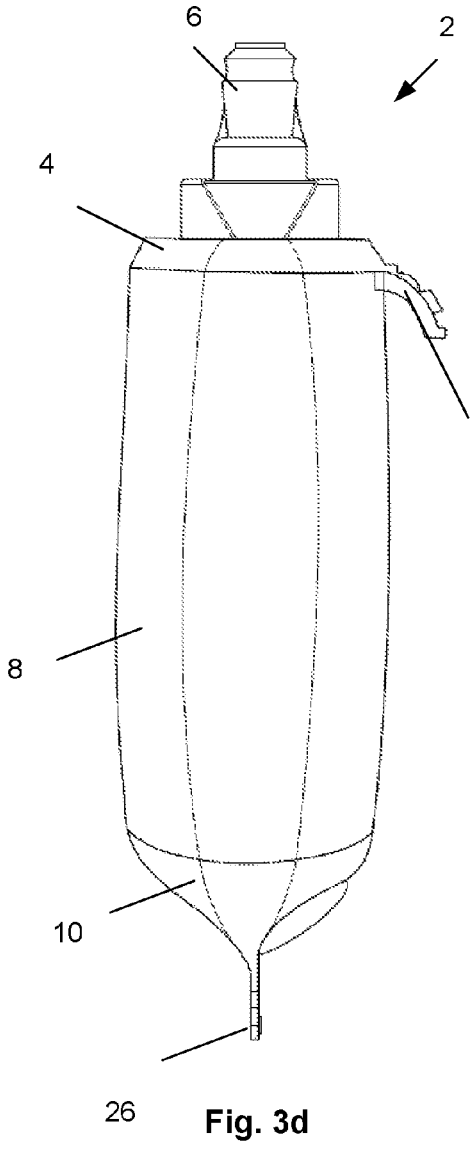
Figure 3E:
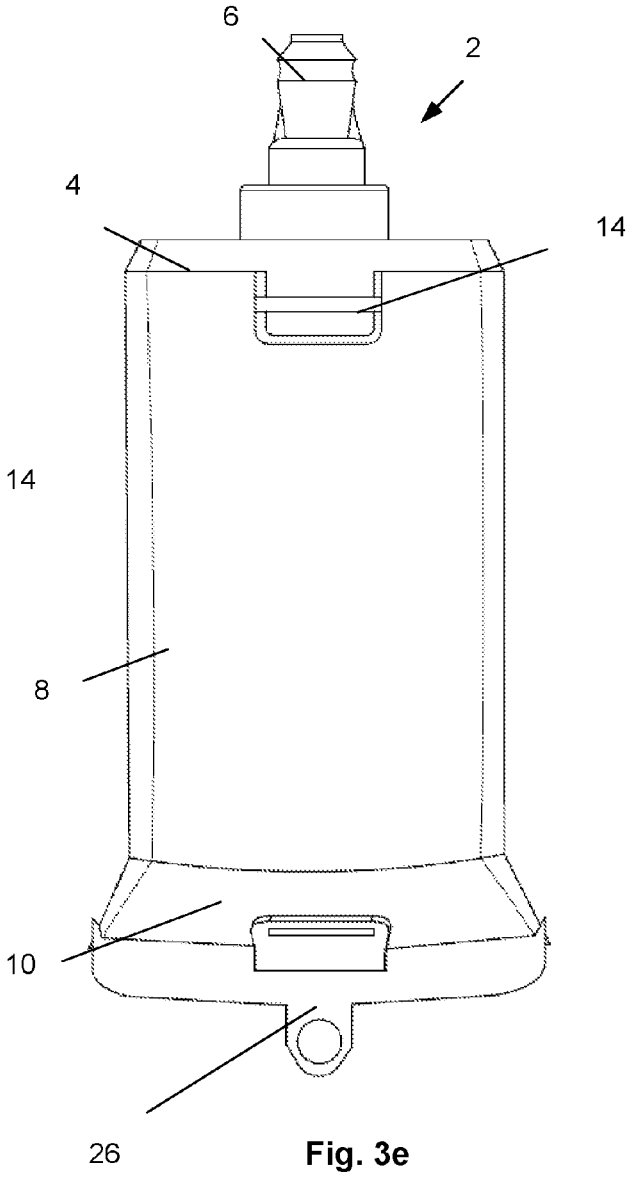
Figure 3G:
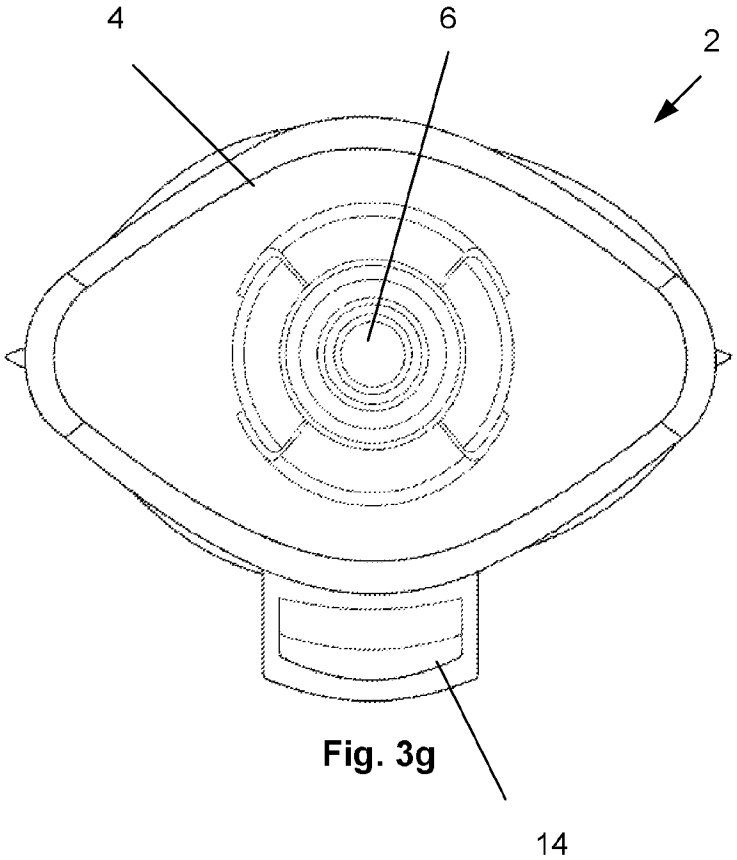
Figure 3F:
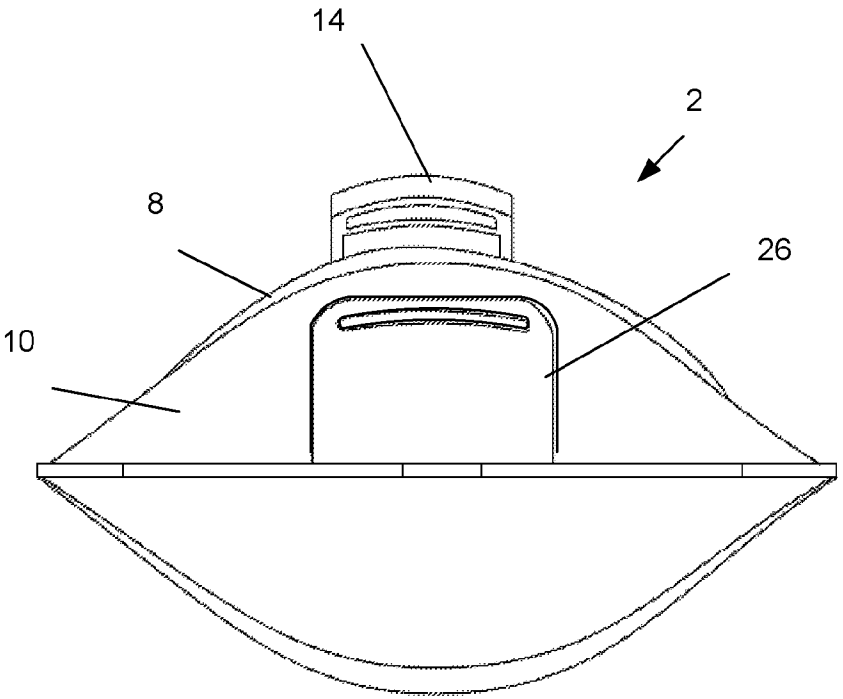

A handle bottom second slot 38 can be formed between the bottom handle adjuster frame 28 and the bottom cup 10, as shown in FIG. 3*b*. The bottom handle adjuster 26 can have a divot, notch or chunk absent from the handle adjuster frame, which can form the handle bottom second slot 38 through which the handle 12 can extend.

The bottom handle adjuster 26 can have one or more bottom cord tabs 40 extending downward, upward, rearward, forward, or combinations thereof, from the bottom handle adjuster frame 28. The bottom cord tab 40 can have a bottom cord hole 42, for example, configured to attached to a cord, line, rope, carabiner, hanger, or combinations thereof.

Figure 8:
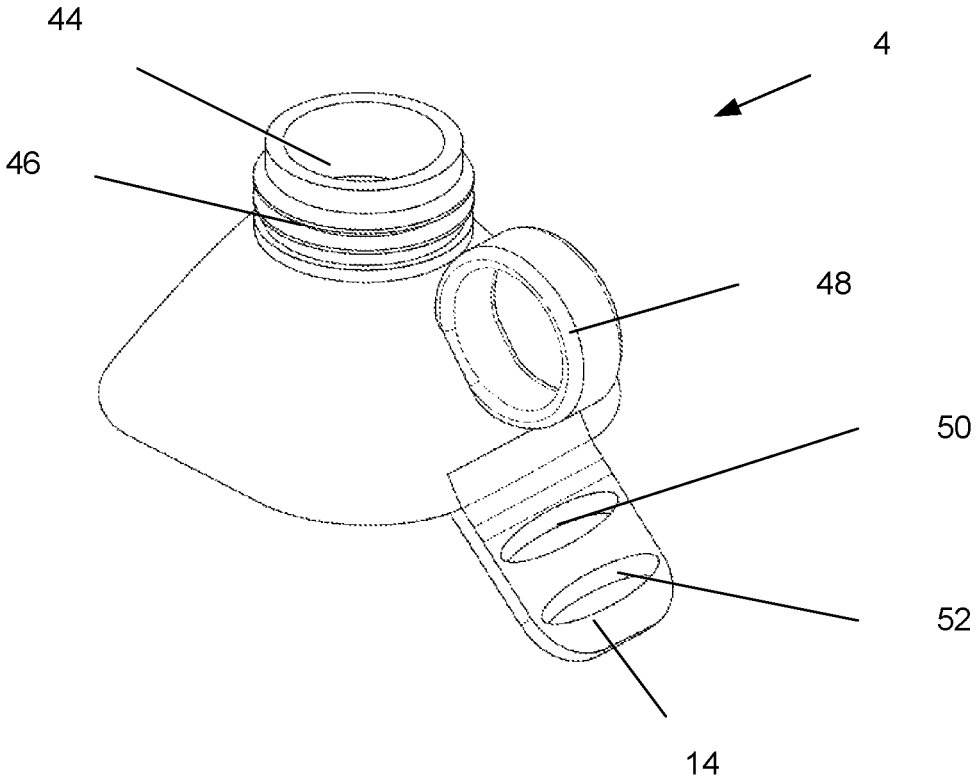
FIG. 8 illustrates a variation of the container top.

FIG. 8 illustrates that the container top 4 can have a port 44 open therethrough. During use, fluid can pass through the port 44 into and out of the reservoir 8. The port 44 can have port threads 46, or other attachment elements, such as latches, clips, or combinations thereof. The port 44 can be attached, such as at the port thread 46, to the nozzle 6.

The container top 4 can have a finger loop 48. The finger loop 48 can extend laterally or radially from the side of the container top 4. The finger loop 48 can be cylindrical.

The container top 4 can have a top handle adjuster tab 14. The top handle adjuster tab 14 can extend radially away and downward or upward from the remainder of the container top 4. The top handle adjuster tab 14 can have a top handle upper slot 50 and/or a top handle lower slot 52. The top handle upper and lower slots can be elongated apertures or slits. The handle 12, such as a flexible strap, can be fed through the top handle upper slot 50 and into the top handle lower slot 52. The length of the exposed handle 12 can be adjusted by pushing more length of the handle 12 into or out of the top upper and lower slots.

The top handle upper slot 50 and the top handle lower slot 52 can be oriented longitudinally with respect to the container 2.

As shown in FIG. 8, the container top 4 can have a rounded square footprint.

Figure 9:
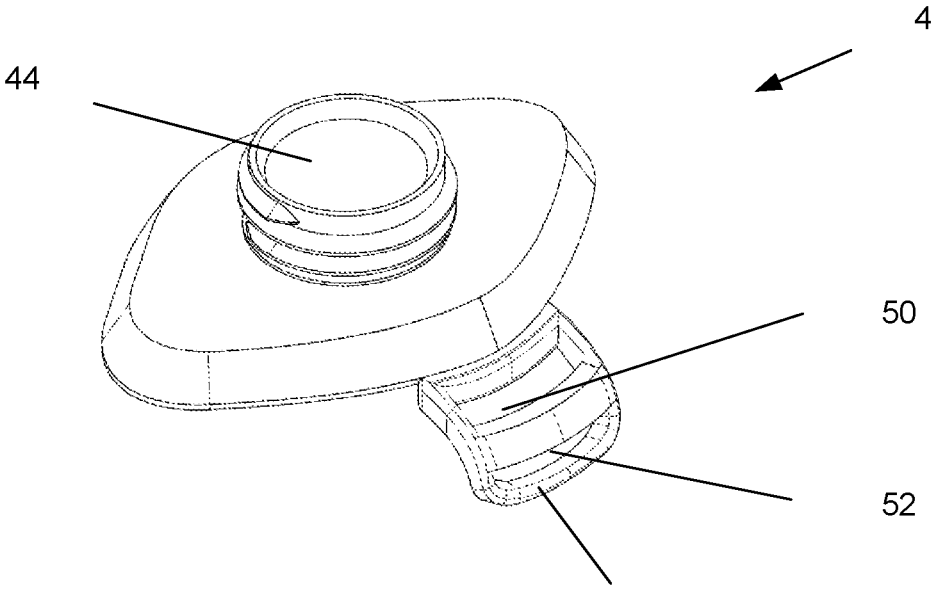
FIG. 9 illustrates a variation of the container stop.

FIG. 9 illustrates that the container top 4 can have the top handle upper slot 50 and the top handle lower slot 52 be oriented laterally or radially with respect to the container 2.

As shown in FIG. 9, the container top 4 can have a rounded diamond or oval footprint.

Figure 10:
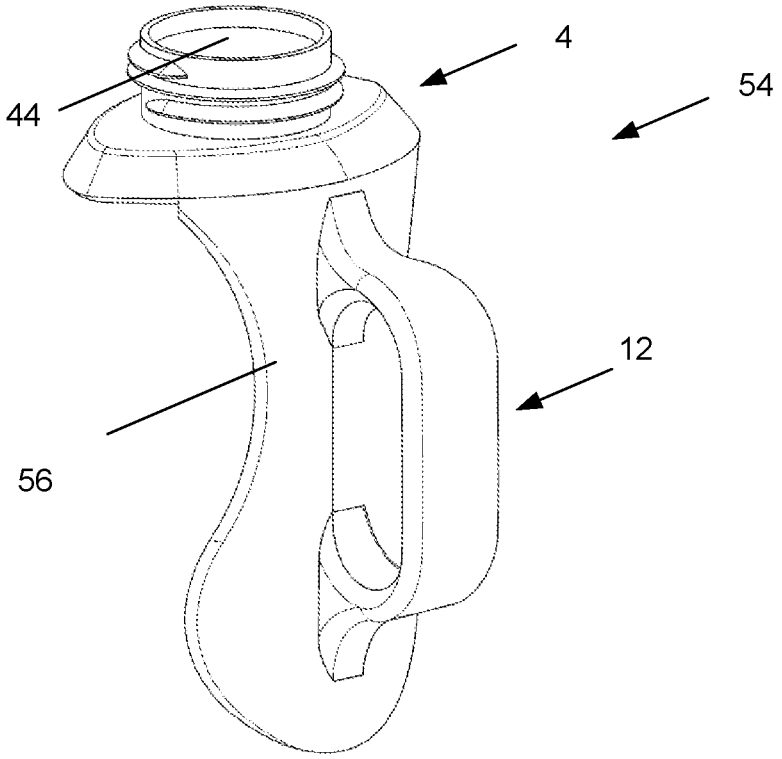
FIG. 10 illustrates a variation of the container top integrated with the handle.

FIG. 10 illustrates that the container top 4 can be integrated into a single combined, molded with the handle 12 into a handle assembly 54. The handle assembly 54 can be hard and rigid, and or flexible. For example, the handle 12 can be made from plastic, a polymer, metal, a composite (e.g., carbon fiber), fabric (e.g., webbing), or combinations thereof.

The handle assembly 54 can have a lateral wall 56. The lateral wall 56 can be rigid or flexible. The lateral wall 56 can by be integrated with (i.e., molded as a single piece) or fixedly or removably attached to the container top 4. The lateral wall 56 can integrated with or fixedly or removably attached to the handle 12. The lateral wall 56 can extend longitudinally along the side of the reservoir 8. The lateral wall 56 can be attached or unattached to the reservoir 8. The lateral wall 56 can extend short of the bottom of the container 2, leaving the bottom of the reservoir 8 exposed.

The container 2 can be made by molding the container top 4 and/or the container bottom 92, or elements thereof. The container top 4 and/or container bottom 92 can be made from molded polyurethane.

The reservoir can be made from TPU film. For example, the reservoir 8 can be pinch-welded (e.g., like a toothpaste tube) at the bottom of the reservoir 8, or can be gusseted.

The rigid, molded elements can be attached to the flexible materials. For example, the molded elements can be high frequency welded to the flexible polyurethane film reservoir 8.

Figure 11B:
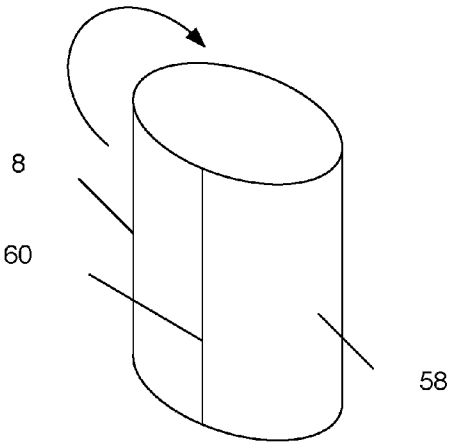
FIGS. 11*b*, 11*b*', 11*b*", and 11*b*"' illustrate variations of the lateral wall or radial perimeter shell of the reservoir.
Figure 11B:
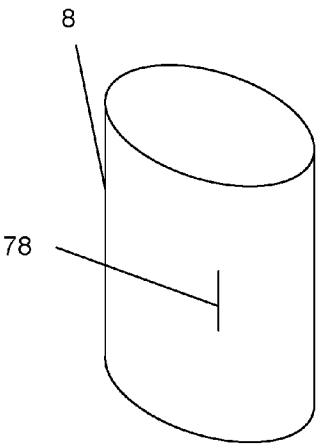
Figure 11A:
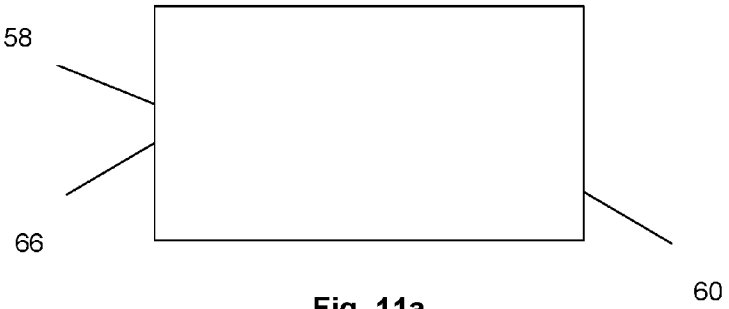
FIG. 11*a* illustrates a variation of a panel that can be formed into the lateral wall or radial perimeter shell of the reservoir.
Figure 11B:
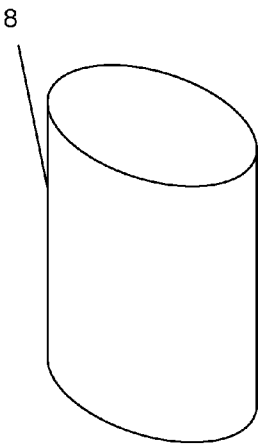
Figure 11B:
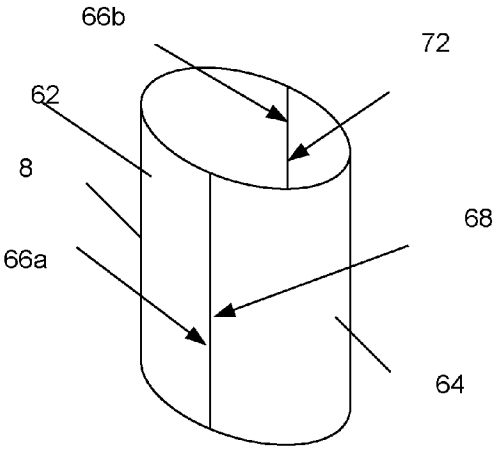

FIGS. 11*a* and 11*b* illustrate that a square or rectangular panel 58 of flexible film material can be curled, as shown by arrow in FIG. 11*b*, to form a hollow cylinder or oval cylinder or elliptic cylinder. The panel 58 can be made from one or more polyurethanes, for example TPU film. The panel 58 can be made from T-die extrusion. The panel 58 can have a hardness from about 83 shore-A durometer to about 87 shore-A durometer, for example about 85 shore-A durometer. The panel 58 can have a thickness from about 0.1 mm to about 0.5 mm, for example about 0.25 mm. The panel 58 can form the radial shell or perimeter of the reservoir 8 (labeled as reservoir 8 in FIGS. 11*b* through 13*a* for illustrative purposes, even though it is not a closed reservoir 8). The panel 58 can have a panel first edge 60 that can be oriented along the height of the reservoir 8 on the radially outer surface of the reservoir 8.

FIG. 11*b*' illustrates that the first panel 62 can be attached to a second panel 64 to form the lateral wall 56 of the reservoir 8. The first and second panels can have respective first and second panel first and second edges. The first panel first edge 66 can be in contact with and/or overlap the second panel second edge 68. The first panel second edge 70 can be in contact with and/or overlap the second panel first edge 72.

FIG. 11*b*'-*i* illustrate that the first panel first edge 66 can attach to the second panel second edge 68 at a pinch joint or pinch weld 74. The first panel second edge 70 can attach to the second panel first edge 72 can attach at a pinch joint or pinch weld 74. The pinch welds 74 can extend radially from the perimeter of the panels 58.

FIG. 11*b*'-*ii* illustrates that the first panel first edge 66 can attach to the second panel second edge 68 at a lap joint 76 or lap weld. The first panel second edge 70 can attach to the second panel first edge 72 can attach at a lap joint 76 or lap weld. The lap joints 76 can extend in the plane of the perimeter of the panels 58.

The pinch weld 74 or lap joint 76 can be used with a single panel 58 attaching to itself. The pinch weld 74 or lap joint 76 can be used in combination, for example the first panel first edge 66 can be attached to the second panel second edge 68 with a lap joint 76 and the second panel first edge 72 can attach to the first panel second edge with a pinch weld 74.

FIG. 11*b*" illustrates that reservoir 8 panel 58 can be made from an integral cylinder of material, such as a tubular extruded or blown film. The reservoir 8 can be seamless.

Figure 11C:
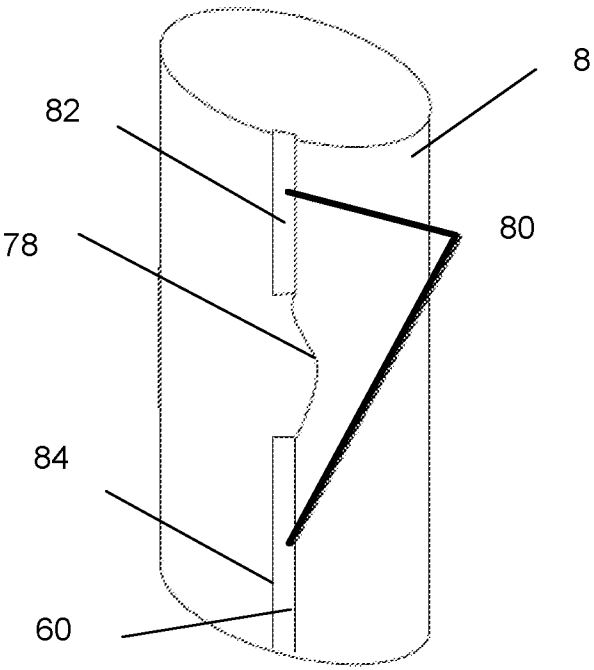
FIG. 11*c* illustrates a variation of the reservoir panel with a variation of a body seam.

FIG. 11*b*'" illustrates that the seamless reservoir 8 panel 58 of FIG. 11*b*" can have a hole cut into the wall in any orientation, such as horizontally or vertically, for example the seam gap 78 as shown. FIG. 11*c* illustrates that one, two or more lengths of the panel 58 along the panel first edge 60 can be sealed to the underlying portion (e.g., the second panel 64 or the second edge of the first panel 62) of the panel 58 along a body seam 80. During assembly and manufacturing of the container 2, the body seam 80 can have a body upper seam 82 and a body lower seam 84 noncontiguous with the body upper seam 82. The body upper seam 82 and the body lower seam 84 can be separated by a seam gap 78.

The panel 58 forming the reservoir 8 can be unattached to itself at the seam gap 78, for example forming a port 44 accessing (e.g., allowing fluid and solid communication to) the radial interior of the reservoir 8 from the radial exterior of the reservoir 8.

The top and/or the bottom of the reservoir 8 can be open. The body seam 80 can be formed according to methods known by those having ordinary skill in the art, such as heat welding, adhesive or epoxying, or combinations thereof. Tools used to create the body upper seam 82 and/or body lower seam 84 can be inserted into the volume of the reservoir 8 through the open top and/or open bottom of the reservoir 8.

Figure 12:
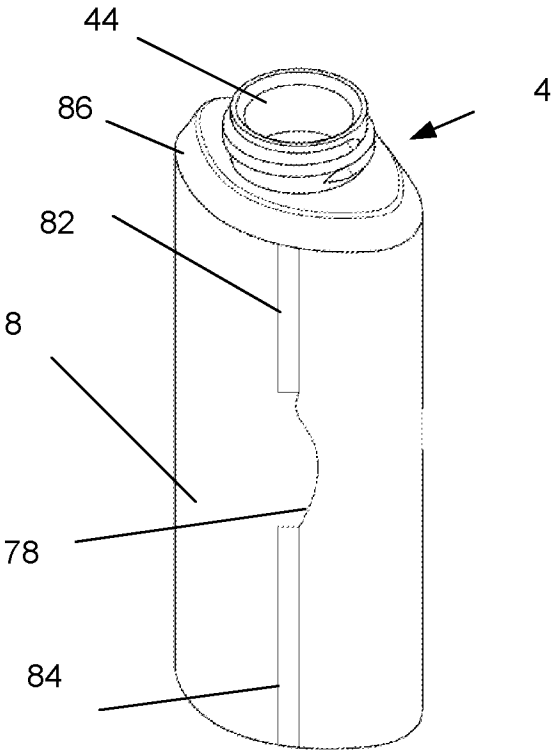
FIG. 12 illustrates a variation of a method for attaching the container top to the reservoir.

FIG. 12 illustrates that the container top 4 can be attached to the terminal top edge of the reservoir 8 at a top seam 86. The top seam 86 can seal the reservoir 8 (i.e., the panel 58 to the container top 4) around the entire perimeter of the previously open top of the reservoir panel 58 and the bottom perimeter of the container top 4. The top seam 86 can be formed by heat welding, adhesion or epoxying, or combinations thereof. Tools used to create the top seam 86 can be inserted into the volume of the reservoir 8 through the open bottom of the reservoir 8.

The reservoir panel 58 can be a flexible thin film. The thin film can be from 0.01 to 0.4.

The container top 4 can have an open port 44 accessing the internal volume of the reservoir 8 from the external environment. The container top 4, for example the body of the container top 4 where the container top 4 connects to the reservoir panel 58, can be made from an injection molded material, such as a polyurethane, for example TPU. The container top 4, for example in the body of the container top 4 where the container top 4 connects to the reservoir panel 58, can have a hardness from about 90 shore-A durometer to about 100 shore-A durometer, for example 92 shore-A durometer or 97 shore-A durometer.

Figure 13A:
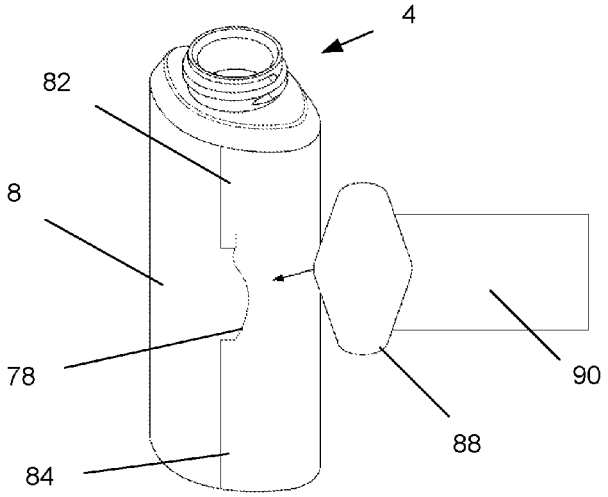
FIGS. 13*a* through 13*d* illustrates a variation of a method for attaching the container bottom to the reservoir.

FIG. 13*a* illustrates that a sealing apparatus, such as a portion of a welding apparatus, can be inserted into the port 44 through the radial wall of the reservoir 8 at the seam gap 78 between the terminal bottom edge 230 of the body upper seam 82 and the terminal top edge of the body lower seam 84. The sealing apparatus can have a welding anvil 88 attached to an anvil handle. The welding anvil 88 can be small enough to fit directly through the port 44 at the seam gap 78, as shown by arrow (the welding anvil 88 and seam gap 78 are shown out of scale with respect to each other in FIG. 13*a* for illustrative purposes). The anvil handle 90 can extend from the welding anvil 88 perpendicular to the plane of the face of the welding anvil 88.

Figure 13B:
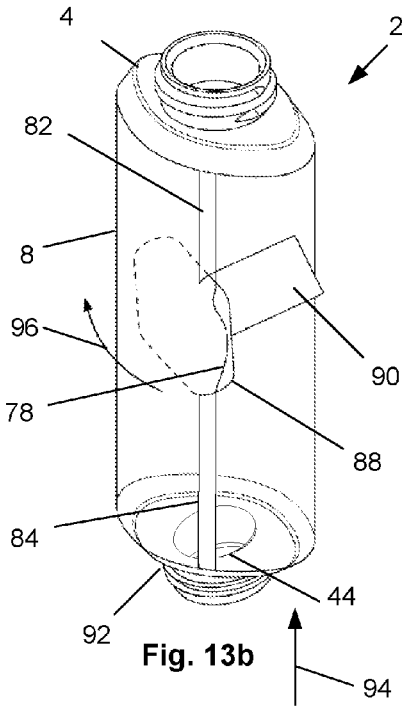

FIG. 13*b* illustrates that a container bottom 92 can be positioned 94, as shown by arrow, in contact with the perimeter of the open bottom of the reservoir panel 58. The container bottom 92 can have an open port 44 accessing the internal volume of the reservoir 8 from the external environment or the container bottom 92 can have no port 44 and the internal volume of the reservoir 8 can be inaccessible through the container bottom 92. The container bottom 92, for example the body of the container bottom 92 where the container bottom 92 connects to the reservoir panel 58, can be made from an injection molded material, such as a polyurethane, for example TPU. The container bottom 92, for example the body of the container bottom 92 where the container bottom 92 connects to the reservoir panel 58, can have a hardness from about 90 shore-A durometer to about 100 shore-A durometer, for example 92 shore-A durometer or 97 shore-A durometer.

The welding anvil 88 can be too large to fit directly through the port 44 at the seam gap 78 and/or any ports 44 in the container top 4 and/or container bottom 92. For example, the welding anvil 88 can be about the size and shape of the perimeter of the reservoir panel 58 where it meets the container bottom 92. For example, the welding anvil 88 can be shaped as an oval, or rhombus or other parallelogram with rounded corners.

Figure 13C:
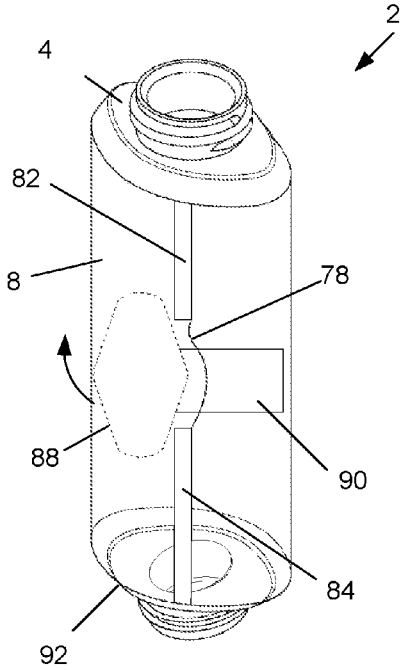

FIGS. 13*b* and 13*c* illustrates that the welding anvil 88 can be rotated and translated 96 into the seam gap 78, as shown by arrows. A first (e.g., the top as shown in FIG. 13*b*) longitudinal end of the welding anvil 88 can be inserted through the seam gap 78 (shown in FIG. 13*b*), followed by the opposite longitudinal end (e.g., the bottom as shown in FIG. 13*c*). The entire welding anvil 88 can be inside of the volume of the reservoir 8 volume. The anvil handle 90 can extend out of the volume of the reservoir 8.

Figure 13D:
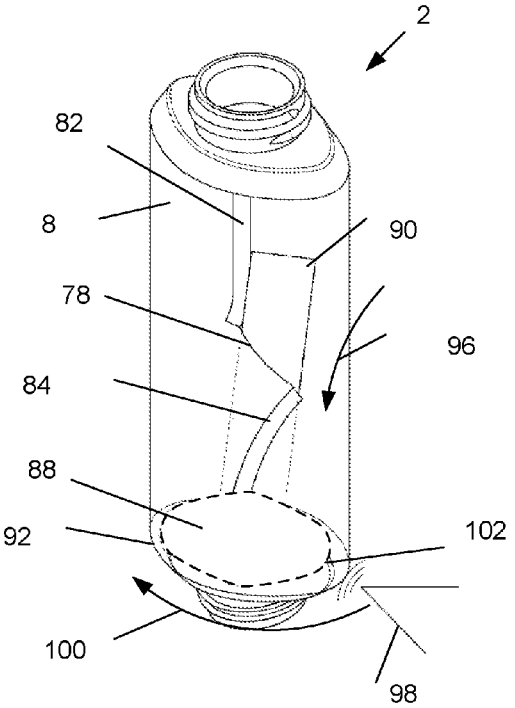

FIG. 13*d* illustrates that the welding anvil 88 can be rotated and translated 96, as shown by arrow, so the perimeter of the welding anvil 88 is positioned against the perimeter bottom of the reservoir panel 58 and the perimeter of the top of the container bottom 92. A welding tool 98, such as a heat gun (e.g., an RF (radio frequency) welder or HF (high frequency) welder), can be positioned radially outside of the reservoir 8 against or adjacent to the position of the perimeter of the welding anvil 88. The welding tool 98 and/or perimeter of the welding anvil 88 can transmit a sealing energy, such as heat, to the area where the bottom of the reservoir panel 58 contacts the top of the container bottom 92. The welding tool 98 can be translated and rotated, as shown by arrow, around the complete perimeter of the reservoir panel 58 and container bottom 92 to create the complete bottom seal. The sealing energy can bond the reservoir panel 58 to the container bottom 92 at a bottom seam 102. The bottom seam 102 can be fluid-impenetrable (i.e., fluid-tight or leak-proof).

The welding anvil 88 can be made from an inert metal or other hard, conductive and heat-tolerant material, such as brass, magnesium, aluminum, or combinations thereof. The welding anvil 88 can act as a hard backing providing a normal force when the welding tool 98 is pressed into the bottom seam 102 and to force the perimeter of the reservoir panel 58 to consistently contact the perimeter of the container bottom 92, and/or deliver a sealing energy (e.g., heat) from an energy source delivered through a conduit attached through the anvil handle 90 or directly to the welding anvil 88.

For example, the welding anvil 88 can have a resistive heating element positioned along the perimeter of the welding anvil 88 (or the entire welding anvil 88 can be a resistive heating element), and an cord delivering electrical power to the resistive heating element can be routed through the anvil handle 90 to the welding anvil 88 and the resistive heating element or connect directly to the resistive heating element without passing through or being attached to the anvil handle 90.

Also the welding anvil 88 can be an anode or cathode and the welding tool 98 can be a cathode or anode, respectively. The welding anvil 88 or welding tool 98 can be electrically grounded. The welding anvil 88 and welding tool 98 can be an RF welding system or HF welding system.

The relative motion of the welding anvil 88 and the elements of the container 2 as shown in FIG. 13*a* through 13*d* is not subject to motion of either container 2 elements or anvil with respect to the environment. For example, the anvil can be held stationary with respect to the external environment and the reservoir 8 can be slipped over the anvil, or the reservoir 8 can be held stationary with respect to the external environment and the anvil moved into the anvil, or a combination thereof.

Figure 14A:
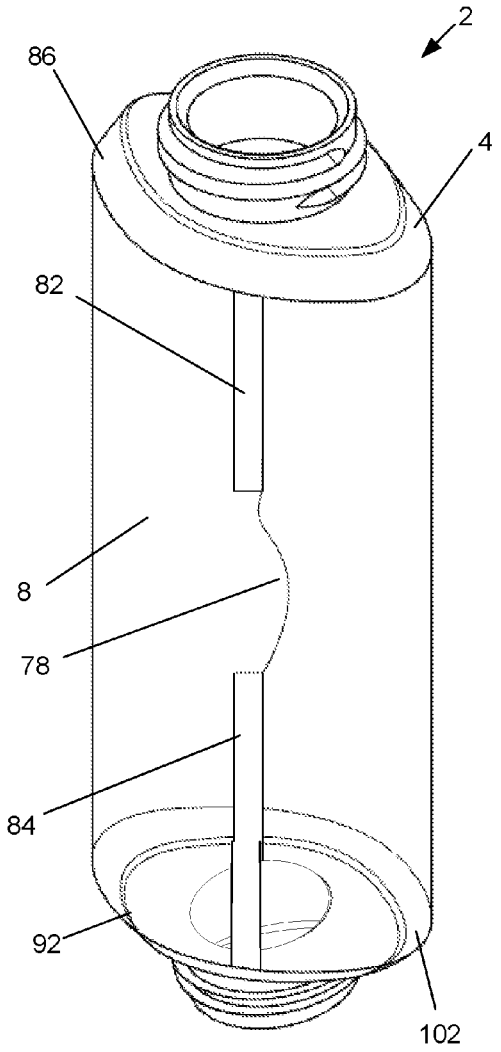
FIGS. 14*a* and 14*b* illustrate a variation of a method for sealing the seam gap.

FIG. 14*a* illustrates that after the container bottom 92 is fixedly attached to the reservoir 8 and the bottom seam 102 is formed around the entire perimeter of the reservoir 8, the welding anvil 88 and anvil handle 90 can be removed from the reservoir 8, for example by reversing the method used to insert the welding anvil 88 and anvil handle 90 into the reservoir 8.

Figure 14B:
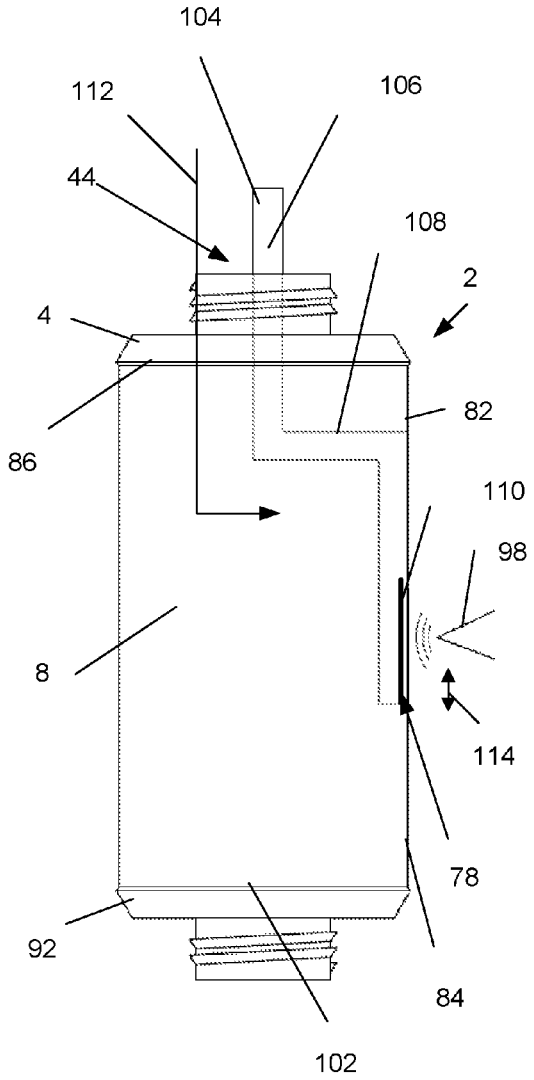

FIG. 14*b* illustrates that a seam gap 78 anvil (i.e., a second welding anvil 88, shaped differently than the container bottom 92 welding anvil 88 used in FIGS. 13*a* through 13*d*) can be inserted through the port 44 in the container top 4. The gap anvil 94 can have a gap anvil leg 106, a gap anvil neck 108 and a gap anvil head 110. The gap anvil neck 108 can extend at a neck 162 extension angle from about 45° to about 130°, for example at about 90°, from the terminal end of the gap anvil leg 106. The gap anvil head 110 can extend at a head extension angle from about 50° to about 135°, for example at about 90° from the terminal end of the gap anvil neck 108 away from the gap anvil leg 106.

The gap anvil 94 can be inserted into the volume of the reservoir 8 body, as shown by arrow. For example, the gap anvil 94 can be translated down into the reservoir 8 body, then the gap anvil 94 can be translated laterally until the gap anvil head 110 is positioned against the radially inner wall of the reservoir 8 body against the seam gap 78.

A welding tool 98, described supra, can be placed adjacent to the seam gap 78. The welding tool 98 and the gap anvil head 110 can seal the seam gap 78 as described, supra, for the bottom seam 102. The welding tool 98 can translate 114, as shown by arrow, up and/or down along the gap seam. The welding tool 98 can translate 114 onto the body upper seam 82 and/or body lower seam 84, for example to extend the seal onto the already-sealed body upper seam 82 and/or body lower seam 84.

Figure 15:
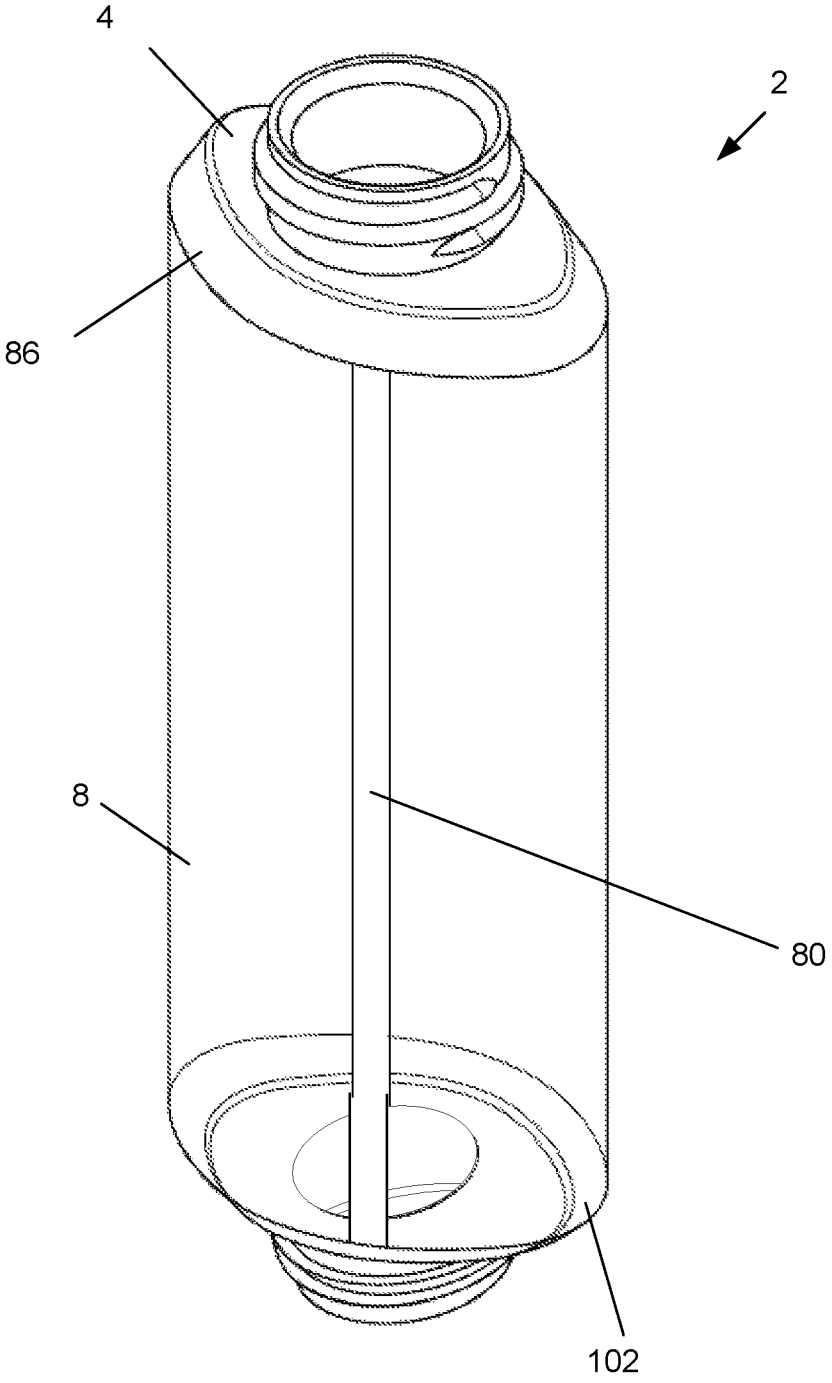
FIG. 15 illustrates a variation of the container.

FIG. 15 illustrates that assembled container 2 can have a container top 4 fixedly attached at the leak-proof top seam 86 to the reservoir panel 58 along the entire perimeter of the container top 4 and the top of the reservoir panel 58. The container bottom 92 can be fixedly attached at the leak-proof bottom seam 102 to the reservoir panel 58 along the entire perimeter of the container bottom 92 and the bottom of the reservoir panel 58. The body seam 80 can be a contiguous sealed and leak-proof seam from the container top 4 to the container bottom 92.

Figure 16C:
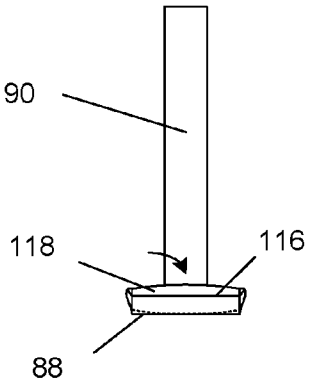
FIGS. 16*b* and 16*c* illustrate a variation of a method of folding the welding anvil of FIG. 16*a*.
Figure 16B:
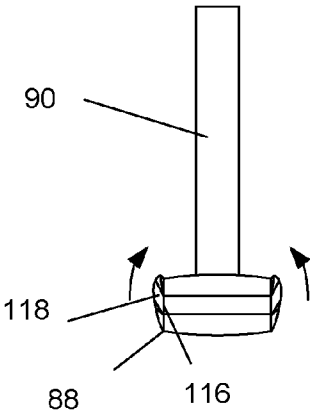
Figure 16A:
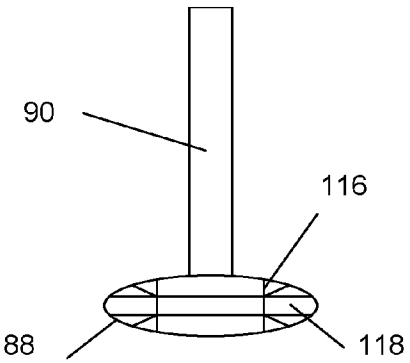
FIG. 16*a* illustrates a variation of the welding anvil and anvil handle.

FIG. 16*a* illustrates that the welding anvil 88 can have one or more controllable joints or anvil folds 116 that define one or more planar or curved anvil panels 118. The anvil folds 116 can be controllably folded by a control system that extends through the anvil handle.

FIG. 16*b* illustrates that the anvil folds 116 at opposite ends of the welding anvil 88 can be rotated upward, as shown by arrows, or downward to radially contract the footprint of the welding anvil 88.

FIG. 16*c* illustrates that anvil folds 116 opposite to each other and perpendicular to the anvil folds 116 rotated in FIG. 16*b* can be upward, as shown by arrows, or downward to further radially contract the footprint of the welding anvil 88. In a radially contracted configuration, the footprint of the welding anvil 88 can have a square, rectangular, triangular, pentagonal, hexagonal, heptagonal, or octagonal configuration.

Figure 17C:
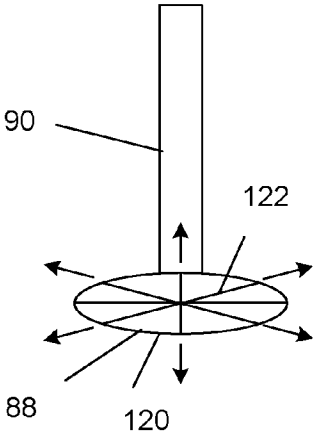
FIGS. 17*b* and 17*c* illustrate variations of radially contracting and expanding, respectively, the welding anvil of FIG. 17*a*.
Figure 17B:
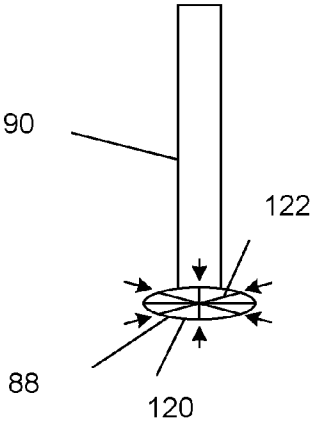
Figure 17A:
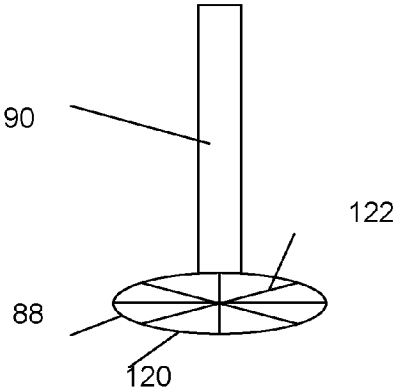
FIG. 17*a* illustrates a variation of a welding anvil and anvil handle.

FIG. 17*a* illustrates that the welding anvil 88 can have an expandable and contractable anvil perimeter 120. The anvil perimeter 120 can, for example, be made from a coil spring. The welding anvil 88 can have one, two, three, four, five, six, seven or eight anvil spokes 122. The anvil spokes 122 can be radially contractable. The anvil spokes 122 can be attached at distal ends to the anvil perimeter 120. The anvil spokes 122 can be attached at proximal ends to a control rod (not shown) that can extend and retract the anvil spokes 122.

FIG. 17*b* illustrates that the anvil spokes 122 can be radially contracted, as shown by arrows. The anvil perimeter 120 can contract and decrease in length and radius.

FIG. 17*c* illustrates that the anvil spokes 122 can be radially extended, as shown by arrows. The anvil perimeter 120 can extend and increase in length and radius.

Figure 18C:
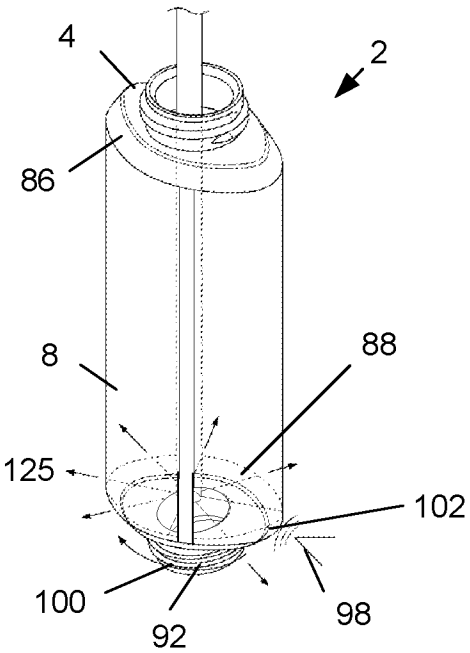
FIGS. 18*a* through 18*c* illustrate a variation of a method for attaching the container bottom to the reservoir.
Figure 18B:
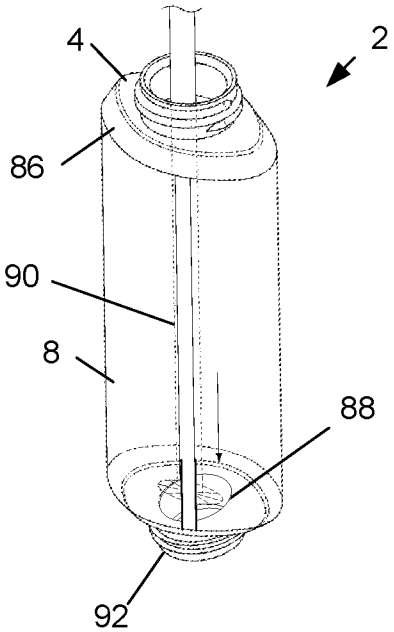
Figure 18A:
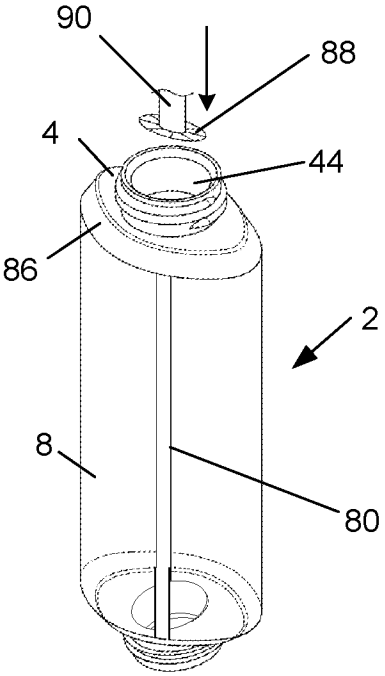

FIGS. 18*a* and 18*b* illustrate that the welding anvil 88 can be translated through the port 44 in the container top 4 and into the volume of the reservoir 8. The welding anvil 88 can be in a radially contracted configuration, for example as shown in FIG. 16*c* or 17*b*. The largest footprint (e.g., when viewed at a perpendicular to the flat plane of the welding anvil 88) can be smaller than the port 44 of the container top 4.

FIG. 18*b* illustrates that the welding anvil 88 can be positioned approximately radially central to the reservoir's lateral wall 56 (e.g., the reservoir panel 58). The welding anvil 88 can be positioned vertically even or co-planar with the interface of the reservoir panel 58 and the container bottom 92.

FIG. 18*c* illustrates that the welding anvil 88 can radially expand 125, as shown by arrows or as shown in the reverse of FIGS. 16*a* through 16*c*. The perimeter of the welding anvil 88 can be in contact with the radially-inner perimeter of the reservoir panel 58 and/or container top 4 where the reservoir panel 58 and container top 4 meet or overlap. The welding tool 98 can then be positioned radially outside of the reservoir 8 against or adjacent to the position of the perimeter of the welding anvil 88. The welding tool 98 and/or perimeter of the welding anvil 88 can transmit a sealing energy, such as heat, to the area where the bottom of the reservoir panel 58 contacts the top of the container bottom 92. The welding tool 98 can be translated and rotated 100, as shown by arrow, around the complete perimeter of the reservoir panel 58 and container bottom 92 to create the complete bottom seal. The sealing energy can bond the reservoir panel 58 to the container bottom 92 at a bottom seam 102. The bottom seam 102 can be fluid-impenetrable (i.e., fluid-tight or leak-proof).

The welding anvil 88 can then be radially contracted and then removed from the volume of the reservoir 8 through the port 44 in the container top 4.

Figure 19A:
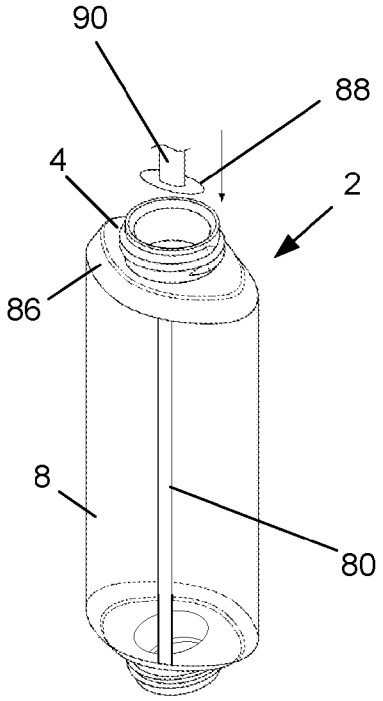
FIGS. 19*a* through 19*d* illustrate a variation of a method for attaching the container bottom to the reservoir.

FIG. 19*a* illustrates that the welding anvil 88 can be translated through the port 44 in the container top 4 and into the volume of the reservoir. The welding anvil 88 can have a fixed radius. The largest footprint (e.g., when viewed at a perpendicular to the flat plane of the welding anvil 88) can be smaller than the port 44 of the container top 4.

Figure 19B:
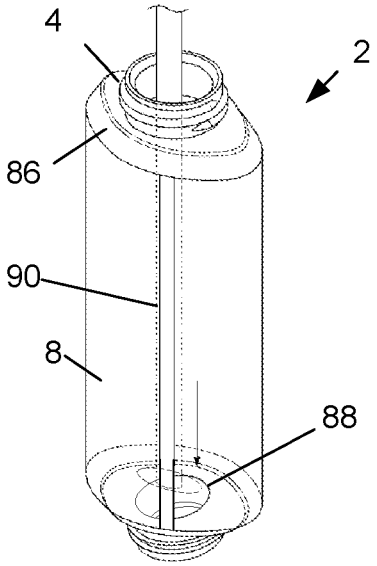

FIG. 19*b* illustrates that the welding anvil 88 can be positioned approximately radially central to the reservoir's lateral wall 56 (e.g., the reservoir panel 58). The welding anvil 88 can be positioned vertically even or co-planar with the interface of the reservoir panel 58 and the container bottom 92.

Figure 19C:
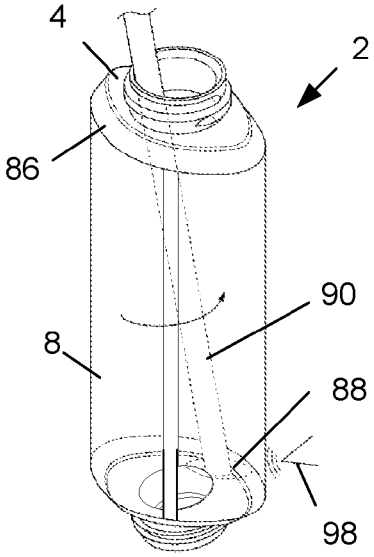

FIG. 19*c* illustrates that the anvil handle 90 can be rotated about a transverse axis, as shown by arrow, and vertically translated as necessary for fine tuning to position a point or length on the perimeter of the welding anvil 88 against the radially-inner perimeter of the reservoir panel 58 and/or container top 4 where the reservoir panel 58 and container top 4 meet or overlap. The welding tool 98 can then can be positioned radially outside of the reservoir against or adjacent to the position of the perimeter of the welding anvil 88. The welding tool 98 and/or perimeter of the welding anvil 88 can transmit a sealing energy, such as heat, to the area where the bottom of the reservoir panel 58 contacts the top of the container bottom 92.

Figure 19D:
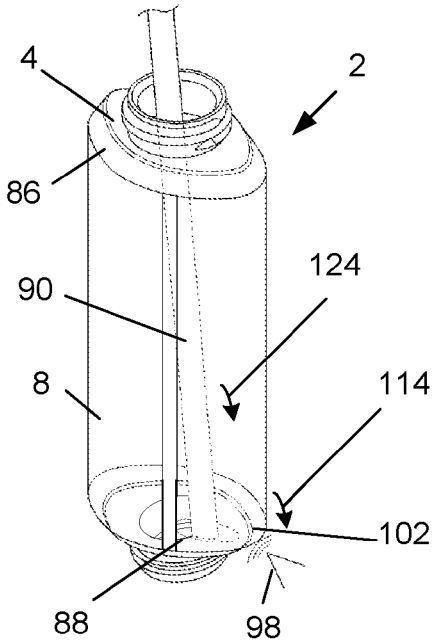

FIG. 19*d* illustrates that the welding tool 98 can be translated and rotated, as shown by arrow, around the complete perimeter of the reservoir panel 58 and container bottom 92 concurrent with the anvil handle 90 being rotated about the longitudinal axis, as shown by arrow, to create the complete bottom seal.

The anvil handle 90 and welding anvil 88 can then be removed from the reservoir through the port 44 in the container top 4.

Figure 20A:
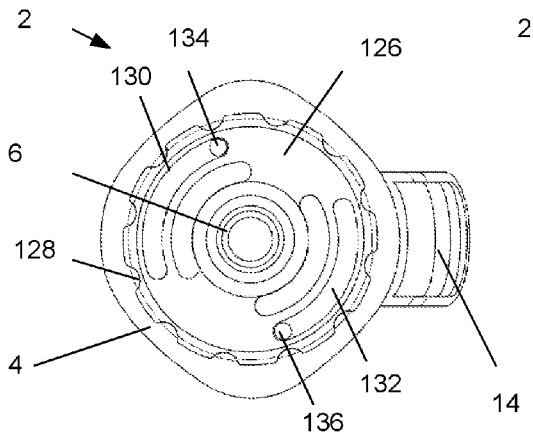
FIGS. 20*a* and 20*a*' are top views of variations of the container.
Figure 20A:
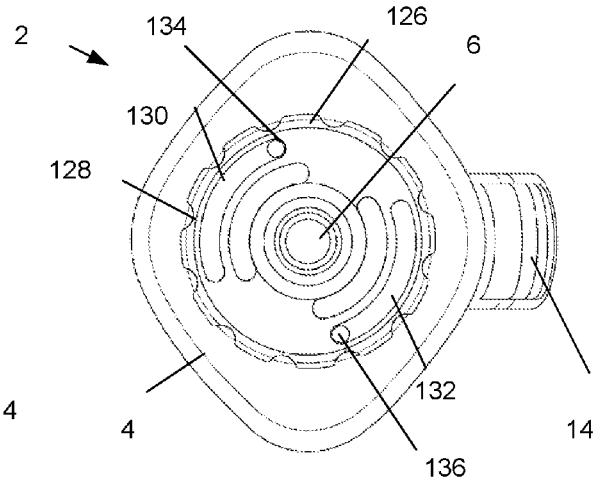
Figure 20B:
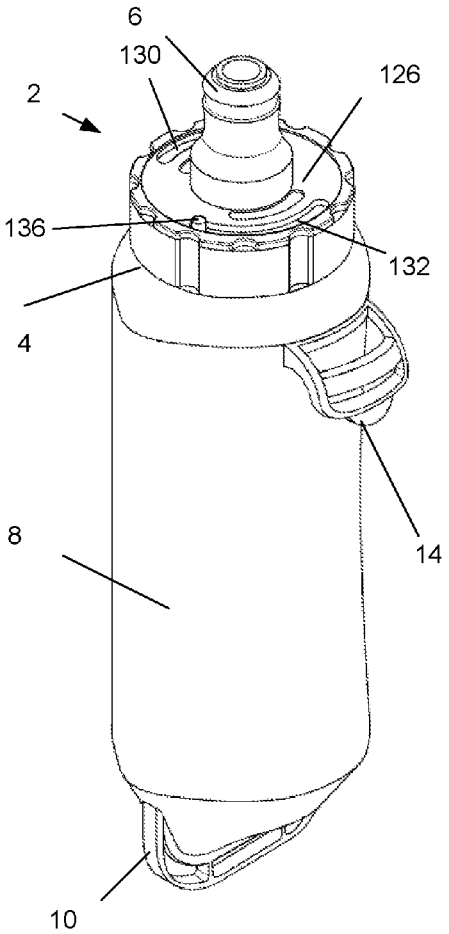
FIGS. 20*b* and 20*b*' are side perspective views of the respective variations of the container of FIGS. 16*a* and 16*a*'.
Figure 20B:
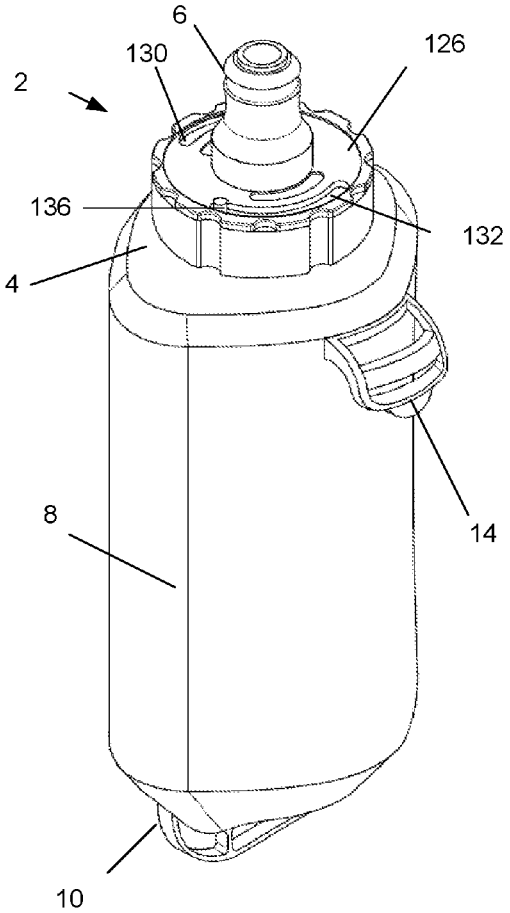

FIGS. 20*a* through 20*b*' illustrate that the container 2 can have a lock disk 126. The lock disk 126 can control a top valve in the container top 4. The top valve can be in an opened, closed, or partially opened configuration. The top valve can be configured to prevent fluid flow through the nozzle 6 when in a closed configuration. The nozzle 6 can be a bite nozzle 6, configured to be opened by squeezing or biting on the nozzle 6. Accordingly, the top valve and the nozzle 6 can each prevent fluid from flowing through the nozzle 6.

The lock disk 126 can be rotatable around a longitudinal axis passing through the longitudinal center of the container 2, such as through the center of the nozzle 6. The perimeter of the lock disk 126 can have finger divots 128, for example for placement of fingers when grasping and rotating the lock disk 126. The lock disk 126 can have a first stop slot 130. The lock disk 126 can have a second stop slot 132. The stop slots can be curved slots.

The container top 4 can have a first stop 134 extending upward into and optionally through the first stop slot 130. The container top 4 can have a second stop 136 extending upward into and optionally through the second stop slot 132. The first 134 and second stops 136 can interference fit against the terminal ends of the respective stop slots to limit the rotation of the lock disk 126. At a first limited (by one or both stops against the first terminal ends of the stop slots) end of rotation, the lock disk 126 can control the top valve to be fully or partially opened. At a second limited (by one of both stops against the second terminal ends of the stop slots) end of rotation, the lock disk 126 can control the top valve to be fully closed.

Figure 21A:
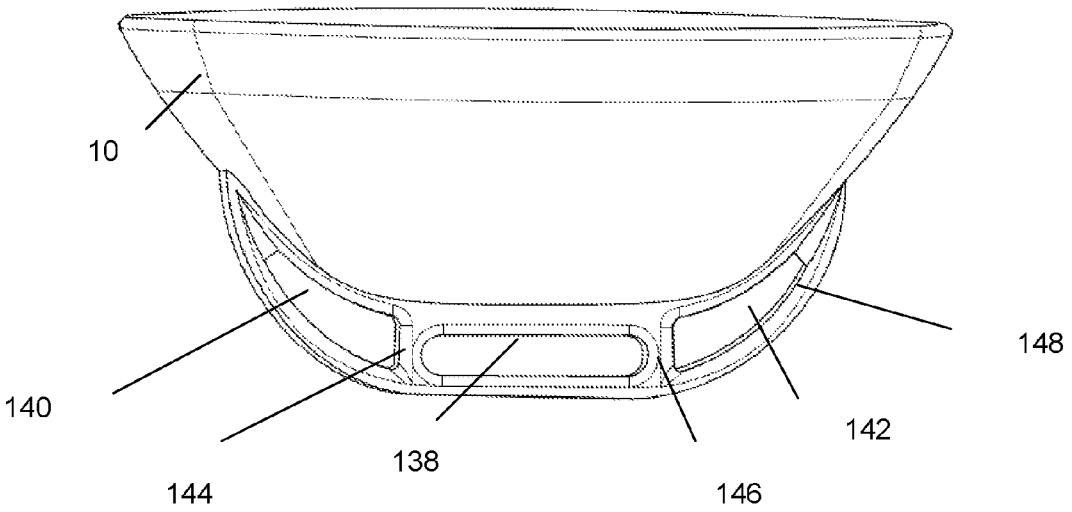
FIGS. 21*a* and 21*b* are front and front perspective views, respectively, of variations of the bottom cup.
Figure 21B:
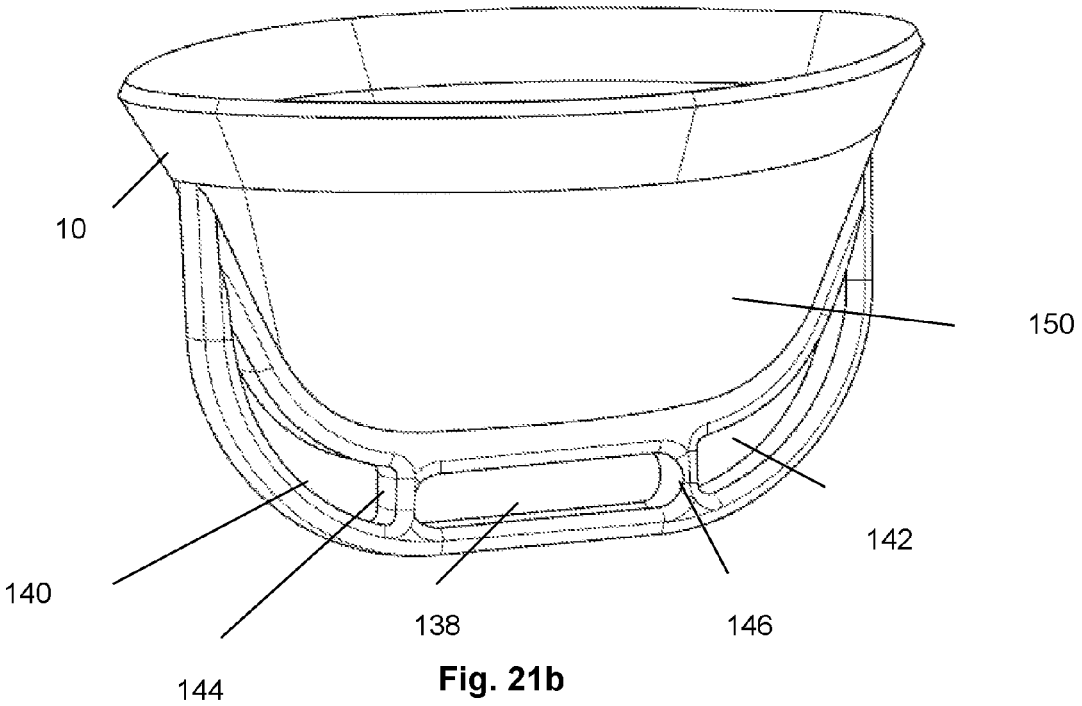

FIGS. 21*a* and 21*b* illustrate that the bottom cup 10 can have a single-slotted, bifurcated or trifurcated handle bottom slot 36. The handle bottom slot 36 can be divided or segmented into a handle bottom center slot 138, handle bottom left slot 140, handle bottom right slot 142, or combinations thereof. The handle bottom center slot 138 can overlap the lateral center of the bottom cup 10.

The handle bottom slot 36 can have a handle bottom left rib 144 between the handle bottom center slot 138 and the bottom left slot. The handle bottom slot 36 can have a handle bottom right rib 146 between the handle bottom center slot 138 and the bottom right slot.

The handle bottom can have a bottom terminal rib 148. The bottom terminal rib 148 can extend along the bottom terminal end of the bottom cup 10 from the lateral end of the handle bottom right slot 142 to the handle bottom left slot 140. For example, the bottom terminal rib 148 can extend across and attach to the handle bottom right rib 146 and the handle bottom left rib 144.

The handle 12 can extend through and/or attach to the handle bottom center slot 138, handle bottom left slot 140, or handle bottom right slot 142. The container 2 can have more than one handle 12, each of which can extend through and/or attach to the handle bottom center slot 138, handle bottom left slot 140, and/or handle bottom right slot 142.

The bottom cup 10 can have one or more embossings 150, such as an image for example branding, wording or combinations thereof. The embossing 150 can be embossed, or be printing, raised relief, or combinations thereof. The embossings 150 can be located above the bottom center slot on one or both of the front and back sides of the bottom cup 10.

Figure 22A:
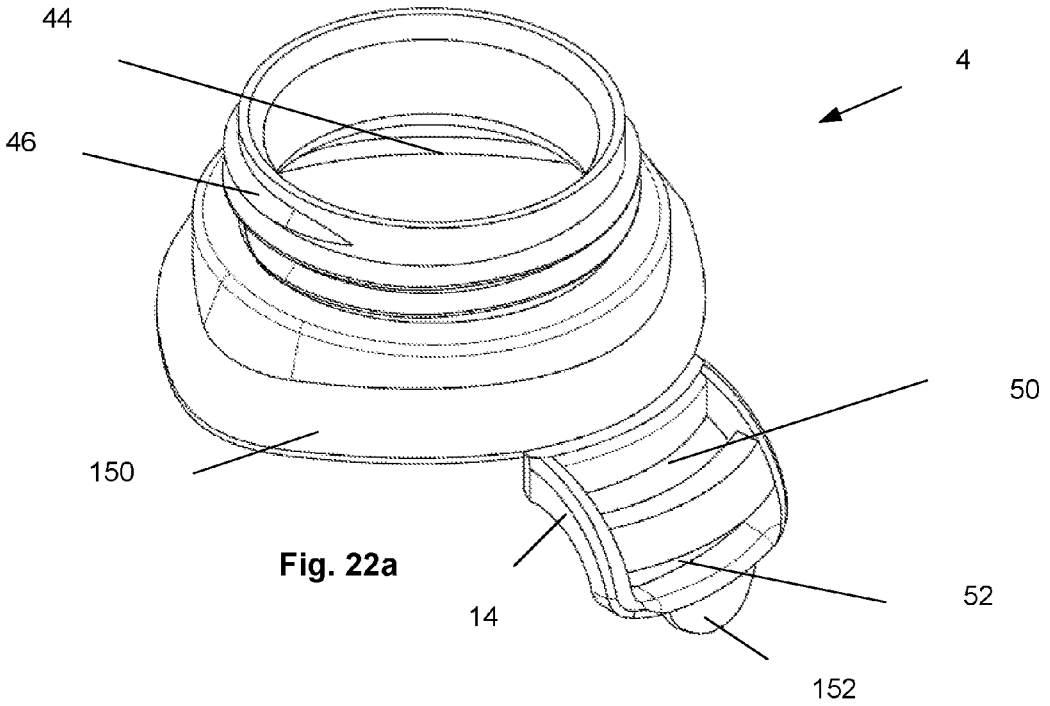
FIGS. 22*a* and 22*b* are top perspective views of variations of the container top.
Figure 22B:
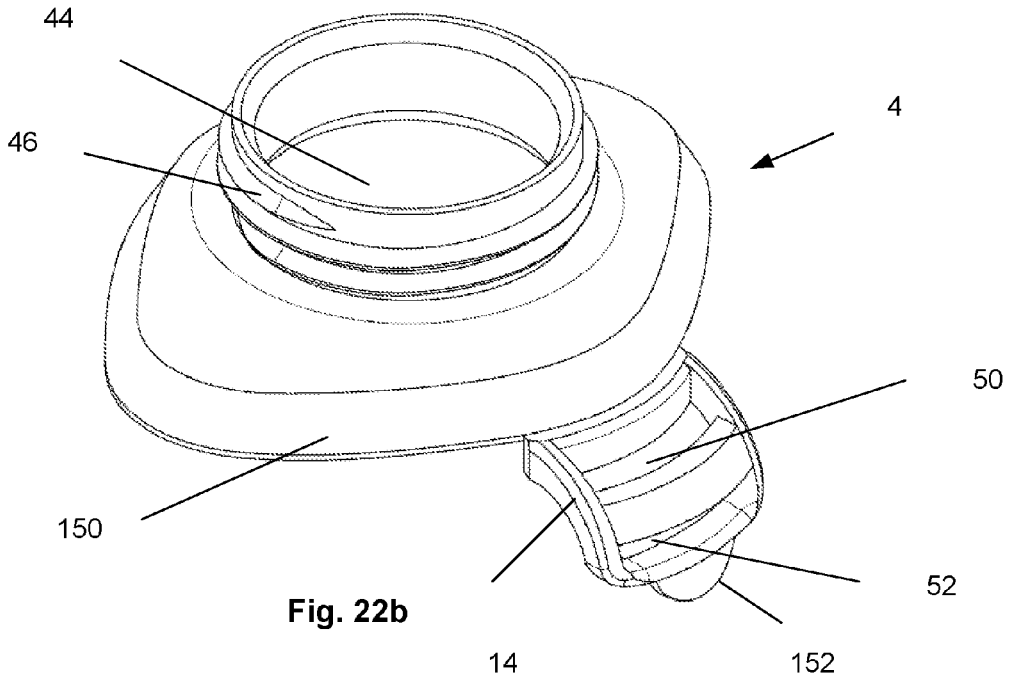

FIGS. 22*a* and 22*b* illustrate that the container top 4 can have one or more embossings 150, for example, on the face of the body of the container top 4 above the top handle adjuster tab 14.

The top handle adjuster tab 14 can have a top handle upper slot 50 and a top handle lower slot 52, as shown in FIGS. 1-3, 8 and 9. The top handle adjuster tab 14 can have a top handle adjuster tab flap 152. The flap can be a panel 58 of material extending to the terminal end of the top handle adjust tab below the top handle lower slot 52. The top handle adjuster tab flap 152 can be grabbed be the user during insertion or adjustment of the handle 12 through the top handle adjuster tab 14.

Rigid elements can be injection molded from polyurethane, die-cut from a sheet of plastic, or other materials that are more structurally robust than a flexible thin film.

Figure 23A:
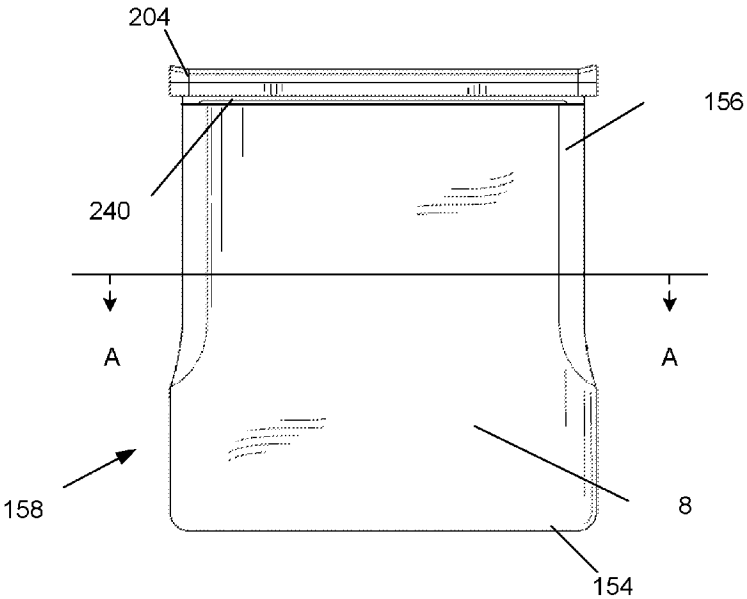
FIG. 23*a* illustrates a variation of a reservoir system.
Figure 23B:
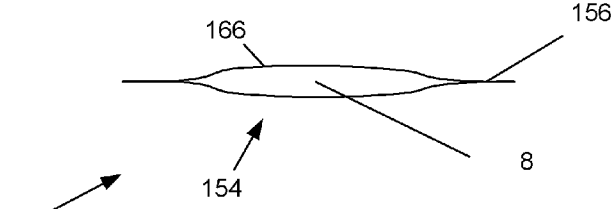
FIG. 23*b* is a variation of cross-section A-A of FIG. 23*a*.

FIGS. 23*a* and 23*b* illustrate that a reservoir system 158 can have a flexible bag 154. The bag 154 can have a hollow internal volume, i.e., a reservoir. The top of the reservoir can have a closable or sealable mouth 232. The mouth 232 can be closable or sealable with a detachable sealing member, such as a slider 204 that can be configured to slide onto and attach to the top of the reservoir. The slider 204 can be leashed to the bag 154. The slider 204 can slide onto, over, or adjacent to a guide 240 on the bag 154. The bag 154 can have one or more bag seals 156 or reinforcements, such as extending along the sides of bottoms of the bag 154.

The reservoir system 158 can have any or all of the elements as described in U.S. Pat. No. 8,043,005, issued Oct. 25, 2011; U.S. patent application Ser. No. 11/445,771, filed Jun. 2, 2006; U.S. patent application Ser. No. 13/353,638, filed Jan. 19, 2012; and U.S. Application No. 61/607,507, filed Mar. 6, 2012, all of which are herein incorporated by reference in their entireties.

FIG. 23*a* illustrates that cross-sectional profile of the reservoir formed by the bag 154 can have a tapered, pinched, or pointed oval shape. For example, the shape can have a tapered, pinched or pointed configuration at opposite corners, such as at the bag seal 156 or reinforcement.

Figure 24A:
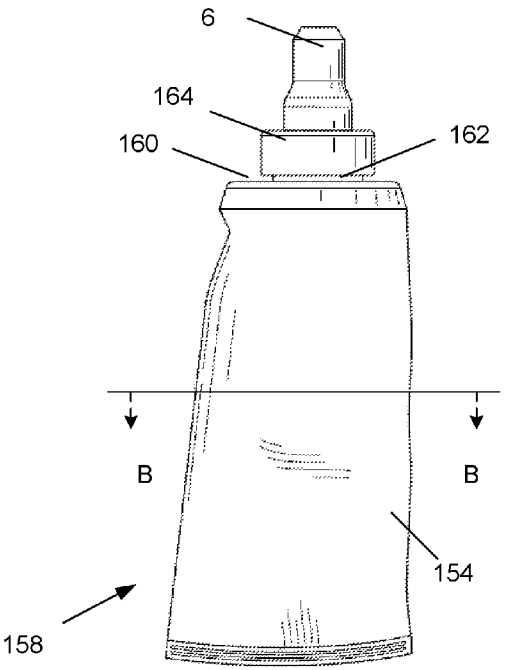
FIG. 24*a* illustrates a variation of a reservoir system.

FIG. 24*a* illustrates that the reservoir system 158 can have a rigid shoulder 160 and neck 162 fixedly or removably attached to the top end of the bag 154. The neck 162 can have a circular configuration and radially external and/or internal neck 162 threads. The reservoir system 158 can have a cap 164. The cap 164 can have an openable and closable nozzle 6. The cap 164 can be removably attached to the neck 162. The cap 164 can have radially internal and/or external cap 164 threads. The cap 164 threads can be removably attached or secured to the neck 162 threads, for example forming a leak-proof seal.

Figure 24B:
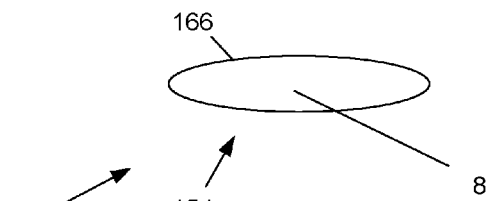
FIG. 24*b* is a variation of cross-section B-B of FIG. 24*a*.

FIG. 24*b* illustrates that the cross-sectional profile of the reservoir formed by the bag 154 can have an oval cross-section.

FIGS. 23*b* and 24*b* illustrate that the bad can have a bag wall 166. The bag wall 166 can be a single ply or layer of material.

Figure 25C:
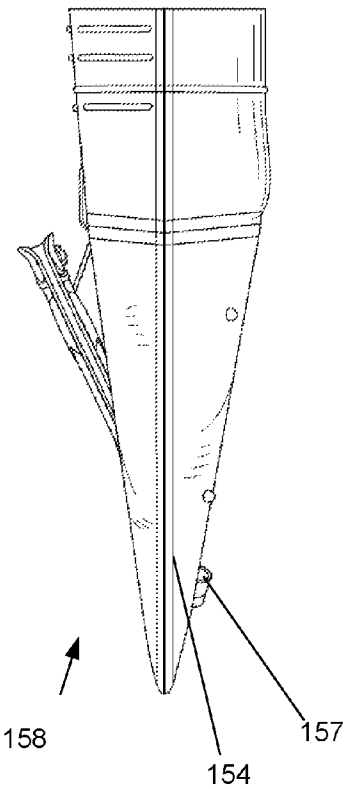
FIGS. 25*a*, 25*b* and 25*c* are front perspective, top, and side views of a variation of a reservoir system in closed, open, and open configurations, respectively, all being held by a hand.
Figure 25B:
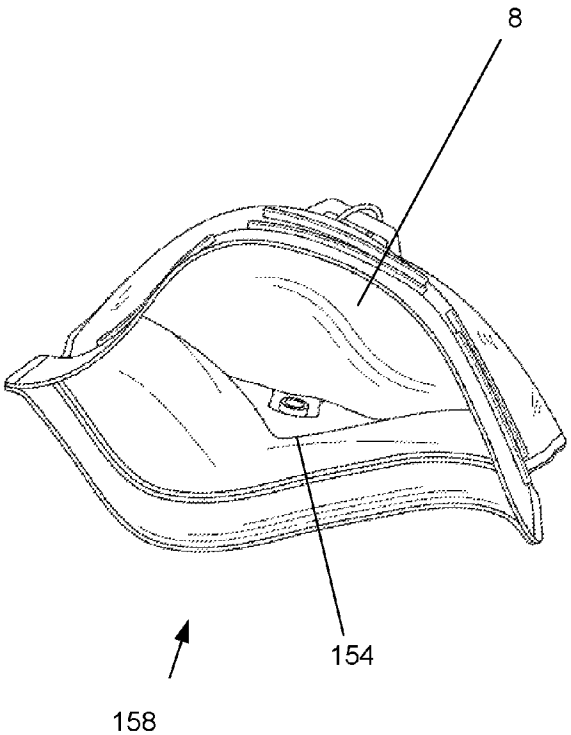
Figure 25A:
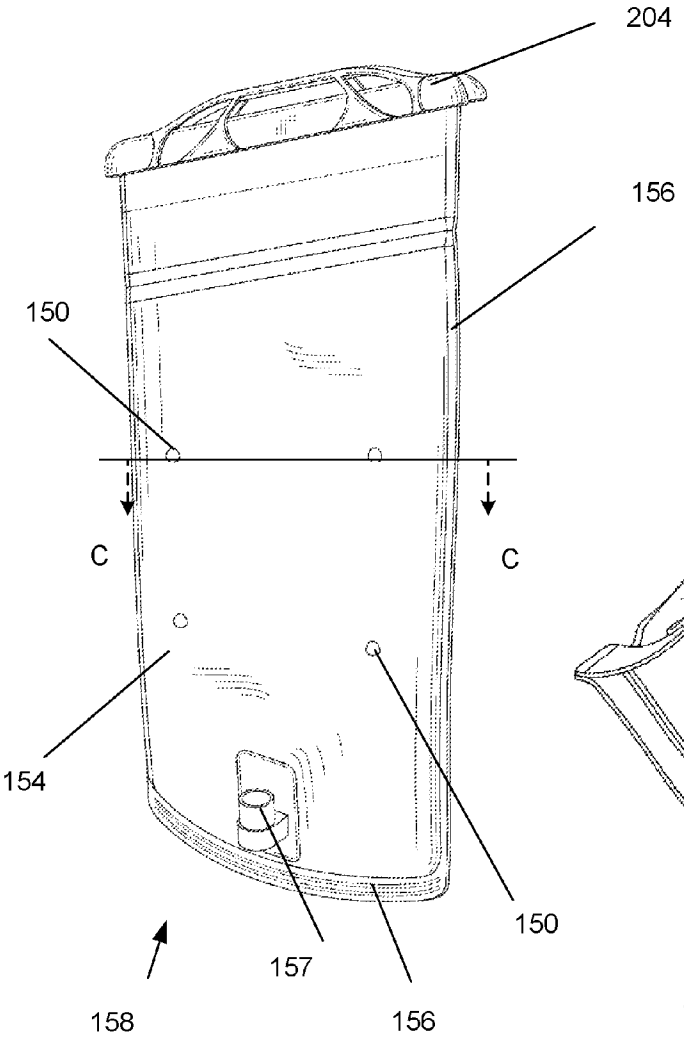

FIGS. 25*a* through 25*c* illustrate that the wall of the bag 154 can have multiple layers, for example in the area bounded by the bag seal 156 or reinforcement. The bag seal 156 or reinforcement can be along the bottom and/or one or both lateral sides. For example, the bag seal 156 or reinforcement can extend along the bottom of the bag 154 and a single lateral side of the bag 154, as shown in FIGS. 25*a* and 25*c*. (FIG. 25*c* shows a straight-on view of the lateral side of the bag 154 without the bag seal 156 or reinforcement). The bag wall 166 can also have an embossing 150 pattern, such as an evenly-spaced two-dimensional grid of embossings 150. The embossings 150 can be in the shape of circles (as shown), squares, lines, or combinations thereof.

Figure 26:
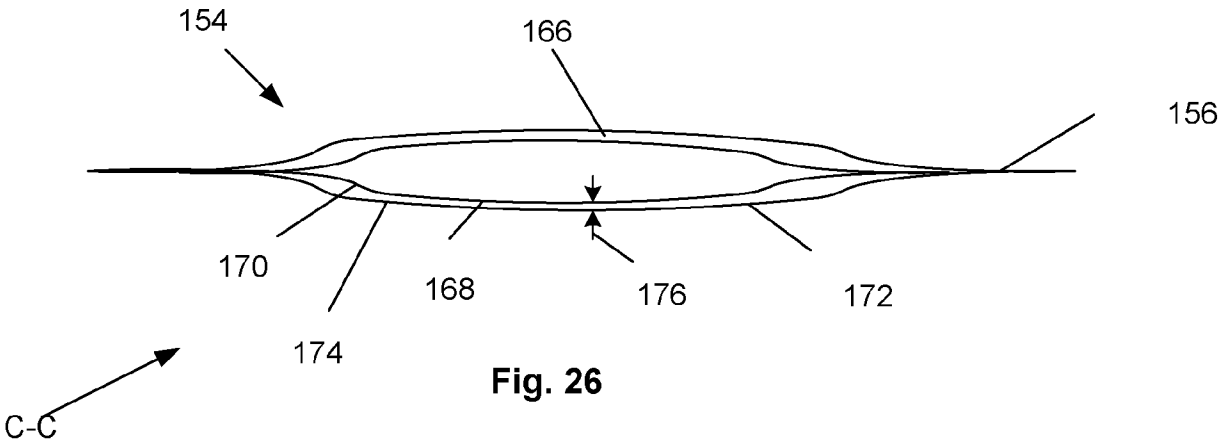
FIG. 26 is a variation of cross-section C-C of FIG. 25*a*.
Figure 27:
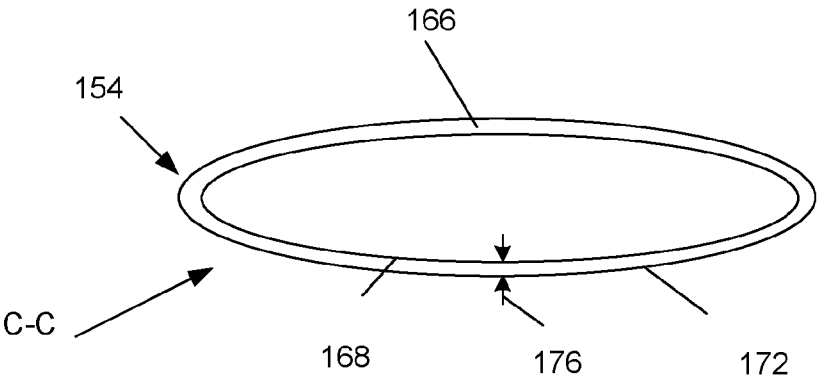
FIG. 27 is a variation of cross-section C-C.

FIGS. 26 and 27 illustrate that the bag wall 166 can have multiple plies or layers. The bag wall 166 can have a bag wall inner surface on an inner layer 170. The bag 154 can have a bag wall outer surface 172 on an outer layer 174. The bag wall outer surface 172 can be separated from the bag wall inner surface by a bag wall thickness. The bag wall thickness 176 can be from about 0.01 mm to about 2 cm, for example about 1 mm. The bag wall thickness 176 can be constant and/or vary along the perimeter of the bag 154. The inner layer 170 can be sealed at or near the perimeter of the inner layer 170 to the outer layer 174, for example at or near the perimeter of the outer layer 174. The volume defined between the inner layer 170 and the outer layer 174 can be partially or completely filled with a fluid insulator, such as air or saline solution. The volume defined between the first layer and the second layer can also or alternately be partially or completely filled with a solid insulator, such as a matted fiber, as further described supra.

Figure 28:
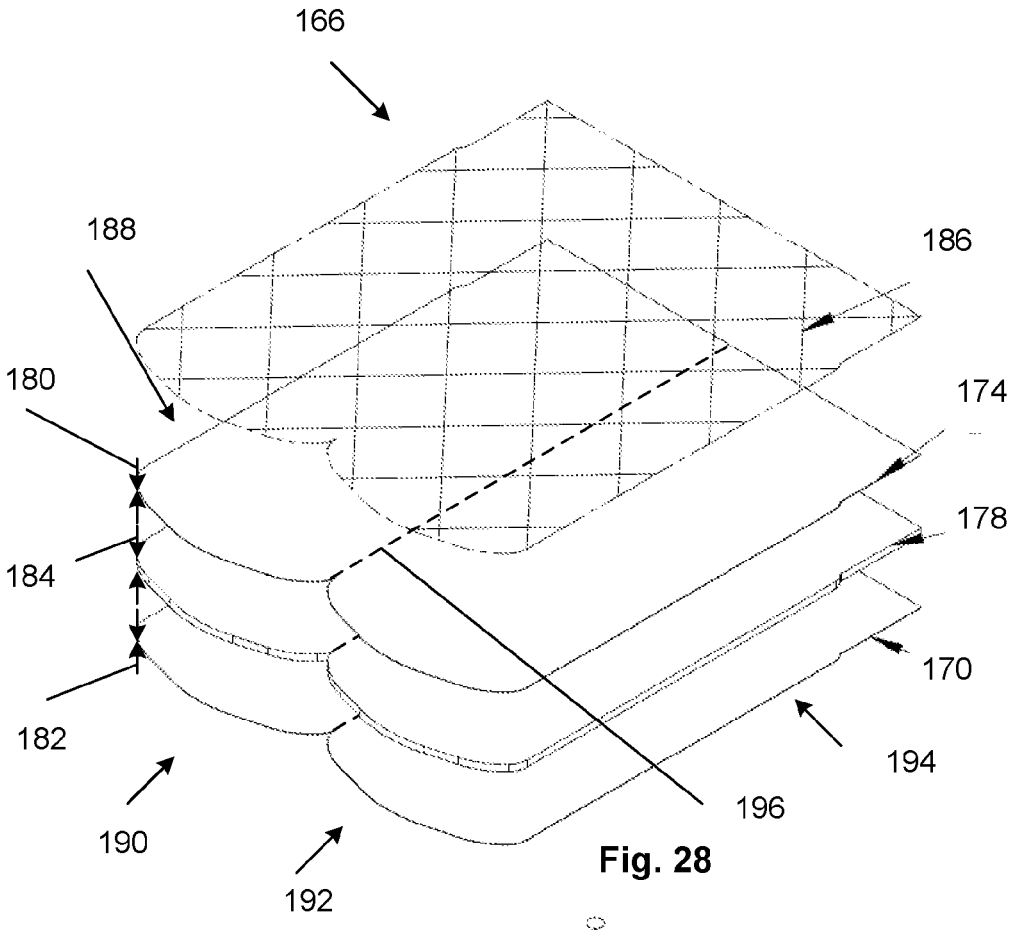
FIG. 28 is an exploded view of a variation of the layers of the bag wall and/or sleeve in a disassembled and flattened configuration.

FIG. 28 illustrates that the bag wall 166 can have an outer layer 174, an inner layer 170 and a middle layer 178. The layers can be a solid film, fiber matte and/or mesh and/or weave, a liquid, foam, gel and/or hydrogel and/or aerogel and/or inert gas (e.g., as insulation in the middle layer 178), or combinations thereof. The layers can be made from polyethylene, such as high density polyethylene (HDPE) or low density polyethylene (LDPE) (e.g., linear LDPE), polytetrafluoroethylene (PTFE), polyurethane (e.g., thermoplastic polyurethane (TPU)), polyvinyl chloride (PVC), thermoplastic elastomer (TPE), polyoxymethylene (POM), also known as acetal resin, polytrioxane and polyformaldehyde (e.g., Delrin by E.I. du Pont de Nemours and Company, Wilmington, Del.), Nylon, a synthetic microfiber insulation (e.g., PrimaLoft, as described in U.S. Pat. Nos. 4,588,635; 4,681,789; 4,992,327; 5,043,207; 5,798,166 which are all incorporated by reference herein in their entireties, and Thinsulate™, from 3M of St. Paul. Minn.) and/or natural insulation-specific (e.g., down) material, or combinations thereof.

For example, the inner and outer layers 174 can be made from different materials or the same material, such as TPU film. The middle layer 178 can be made from the same materials as the inner and/or outer layers 174, and or a different material, such as a synthetic (e.g., Primaloft, Thinsulate) and/or natural (e.g., down) material.

Also for example, the outer layer 174 and inner layer 170 can be made from TPU-backed Nylon sheets (e.g., Nylon fabric with TPU film laminated to the fabric). The middle layer 178 can be sewn to the fabric of the outer and/or inner layer 170 before or after the fabric is welded or laminated with the film.

The entire assembly of the bag wall 166 can then be sealed to make the reservoir.

The middle layer 178 can have an insulating material. For example, the material of the middle layer 178 can have a lower density than the materials of the inner layer 170 and/or the outer layer 174.

The outer layer 174 can have an outer layer thickness 180. The inner layer 170 can have an inner layer thickness 182. The middle layer 178 can have a middle layer thickness 184. The outer layer thickness 180, inner layer thickness 182 and middle layer thickness 184 can be equal to each other or vary. For example, the outer layer thickness 180 can be equal to or less than the inner layer thickness 182. The middle layer thickness 184 can be greater than or equal to the outer layer thickness 180 and/or inner layer thickness 182.

The outer layer thickness 180 can be from about 0.1 mm to about 10 mm, for example about 0.25 mm. The inner layer thickness 182 can be from about 0.1 mm to about 10 mm, for example about 0.25 mm. The middle layer thickness 184 can be from about 0 mm to about 10 mm, for example about 0.5 mm.

The bag wall 166 can be formed by attaching the outer layer 174 to the middle layer 178 and/or to the inner layer 170. The middle layer 178 can be attached to or detached from the inner layer 170 and/or outer layer. Any combination of the inner, middle and outer layers 174 can be attached to each other by adhesives, welding (e.g., RF welding), sewing, molding, heat stamping, or combinations thereof. For example, the first, middle and inner layers 170 can be embossed to each other by RF welding. The embossing 150 can be performed in an embossing pattern 186 having an evenly spaced grid of lines, oriented at about 90° or about 45° (as shown) to one or both lateral edges.

The bag wall 166 with the layers attached to each other can have a left lateral edge 188, a left bottom edge 190, a right bottom edge 192 and a right lateral edge 194. The bag wall 166 can have a fold line 196 at the middle of the bag wall 166 between the right lateral edge 194 and the left lateral edge 188. The fold line 196 can extend parallel to the right lateral edge 194 and/or left lateral edge 188 from where the right bottom edge 192 meets the left bottom edge 190. The fold line 196 can extend along part of or the entire length of the bag wall 166. The bag wall 166 can be folded along the fold line 196. All or part of the perimeter (for example, along the top edge of the bag wall 166) can be sealed before or after the bag wall 166 is folded, for example before the embossing pattern 186 is applied. After the bag wall 166 is folded over at the fold line 196, the left lateral edge 188 can be attached and sealed to the right lateral edge 194, and/or the left bottom edge 190 can be attached and sealed to the right bottom edge 192. The attached and sealing can be performed by application of adhesives, welding (e.g., RF welding), heat pressing or stamping, or combinations thereof.

Figure 29:
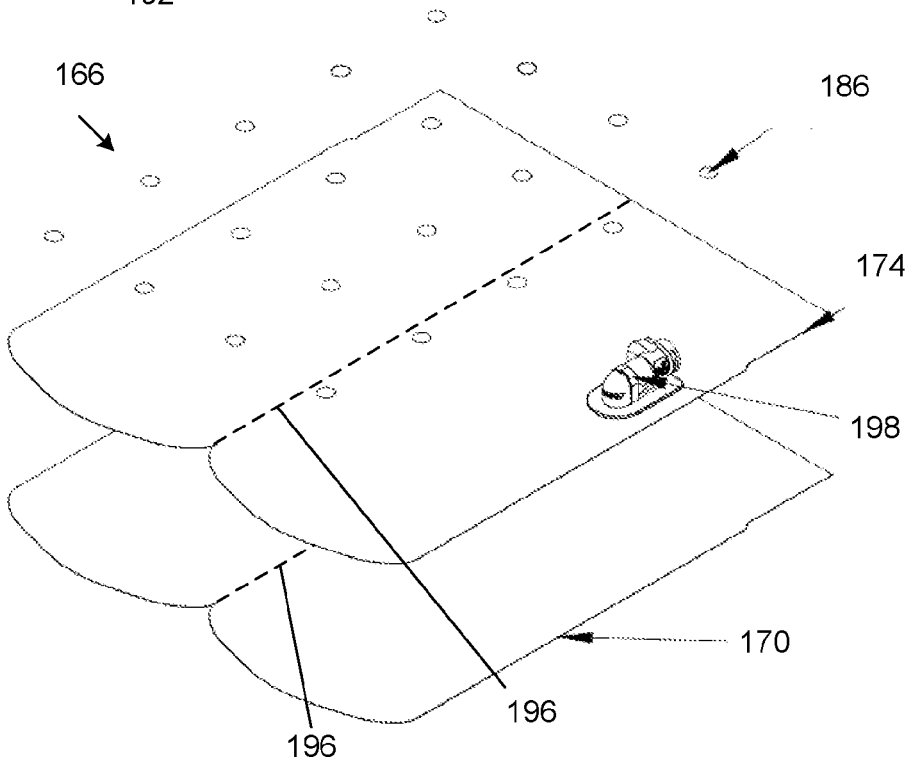
FIG. 29 is an exploded view of a variation of the layers of the bag wall and/or sleeve in a disassembled and flattened configuration.

FIG. 29 illustrates that the embossing pattern 186 can be an orthogonal grid of circular embossings 150. The embossing pattern 186 or tack down pattern, such as the grid of circular embossings 150, can maintain fluid communication throughout the entire volume between the inner layer 170 and outer layer 174. The embossings 150 can secure the outer layer 174 to the inner layer 170 when the volume between the inner layer 170 and the outer layer 174 is inflated, for example with an insulating fluid.

The outer layer 174 can have a wall nozzle 198. The radially internal end of the wall nozzle can extend through the outer layer 174 and be in fluid communication with the volume between the outer layer 174 and the inner layer 170 when the bag wall 166 is assembled. The wall nozzle 198 can allow and control fluid communication between the volume between the inner layer 170 and the outer layer 174 (i.e., the bag wall insulation filler volume or insulation chamber) and the external environment (e.g., a hose attached to the outside port 44 of the wall nozzle 198) radially outside of the outer layer 174.

An insulating fluid and/or solids can be delivered through the wall nozzle 198 into or out of the insulation chamber. The pressure of the insulation chamber can be increased or decreased.

The bag wall 166 can also or alternately have an integrated or attached reservoir nozzle 157, as shown in FIGS. 25*a* and 25*c*. The radially internal end of the reservoir nozzle 157 can extend through the inner layer 170 when the bag wall 166 is assembled. The reservoir nozzle 157 can allow and control fluid communication between the reservoir inside of the inner layer 170 and the external environment (e.g., a hose attached to the outside port 44 of the reservoir nozzle 157) radially outside of the outer layer 174.

The wall nozzle 198 and/or reservoir nozzle 157 can be fixedly attached and or removably attached (e.g., with a snap 274-fit fixture) to the bag wall 166. The wall nozzle 198 and/or reservoir nozzle 157 can each have a valved body, for example for controlling bi-directional and/or unidirectional flow.

The bag wall 166 can have an outer layer 174 and an inner layer 170. The volume of the bag wall 166 between the inner layer 170 and the outer layer 174 can be filled with an insulating fluid and/or gel and/or hydrogel and/or solid (e.g., loose fibers unattached to each other and/or spheres) before the perimeter of the bag wall 166 is sealed between the inner layer 170 and the outer layer 174. The insulating fluid can be air, water, saline solution, propylene glycol, ethylene glycol, an inert gas or combinations thereof.

Figure 30:
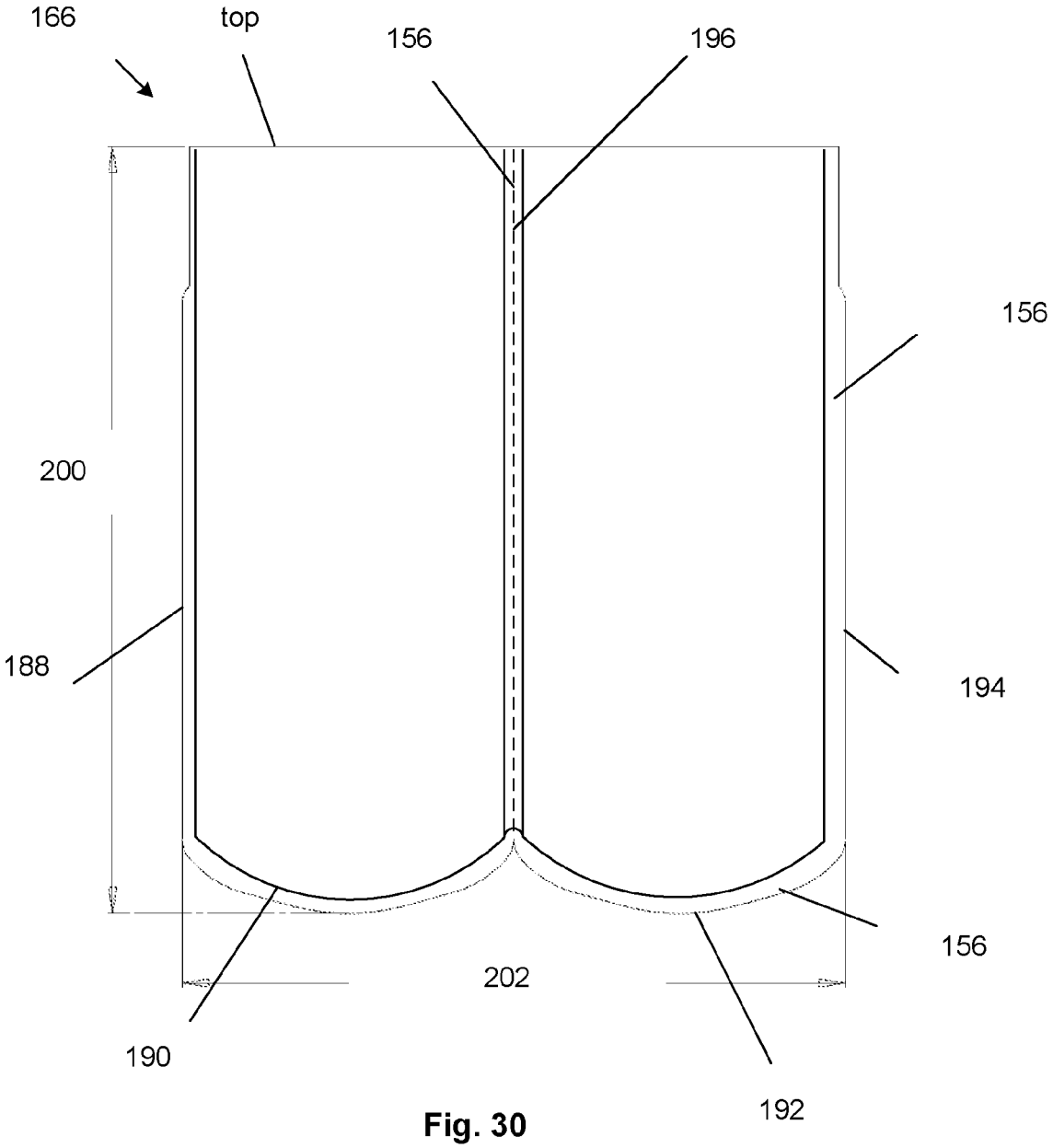
FIG. 30 is a plan view of a variation of the layers of the bag wall and/or sleeve in a disassembled and flattened configuration.

FIG. 30 illustrates that the bag wall 166 can have a bag wall height 200 and a bag wall width 202. The bag wall height 200 can be from about 10 mm to about 450 mm for example about 352.60 mm, and/or 230 mm, and/or 320 mm. The bag wall width 202 can be from about 5 cm to about 30 cm for example about 15 cm and/or 20 cm.

The areas of the bag wall 166 that can be used for the bag seal 156 or reinforcement are shown in FIG. 30 for illustrative purposes (shown in FIG. 8 before being sealed). The bag wall 166 on the left of and/or overlapping the fold line 196 can optionally be sealed (or not sealed, as shown in FIGS. 25*a* and 25*c*) to the bag wall 166 on the right of and/or overlapping the fold line 196.

The multiple layers (i.e., inner and outer layers 174, and optionally with the middle layer 178 and/or insulating fluid or solids) of the bag wall 166 as disclosed herein can be assembled into the form of a sleeve 242, for example, not having a reservoir nozzle 157 nor configured to be attached to a slider 204. The sleeve 242 can be removably slid or translated onto and/or off of the exterior surface of a bag 154. The sleeve 242 can be fixedly and/or removably attached to the bag wall 166.

Figure 31A:
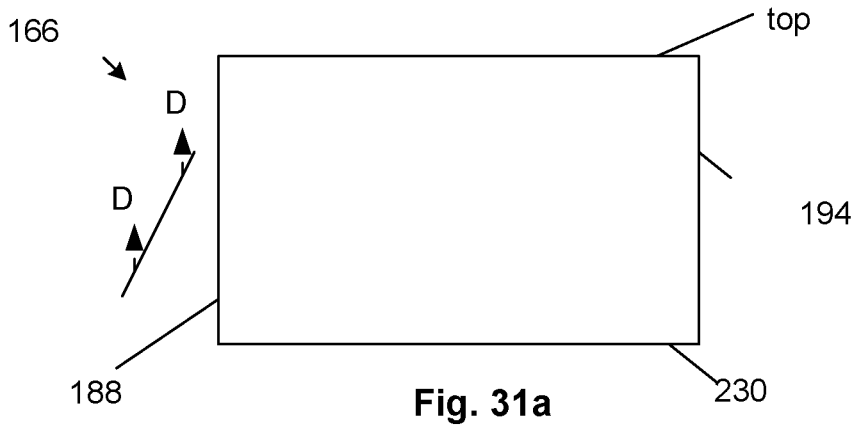
FIG. 31*a* is a plan view of a variation of the bag wall.

FIG. 31*a* illustrates that the bag wall 166 can be a square or rectangle during manufacturing, for example, before being manipulated or formed into the configuration of the reservoir system 158.

Figure 31B:
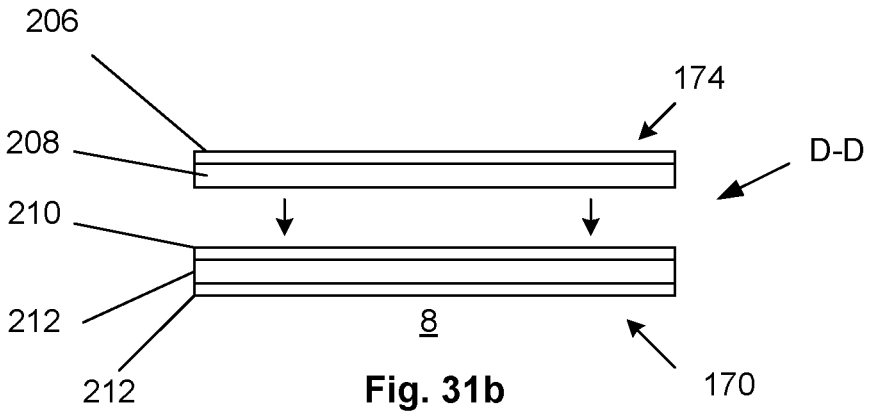
FIG. 31*b* is a variation of cross-section D-D during a method of manufacturing the bag wall of FIG. 31*a*.

FIG. 31*b* illustrates that the bag wall 166 can be made from an outer layer 174 and an inner layer 170. The inner layer 170 and/or outer layer 174 can be laminates. The outer layer 174 can have an outer layer outer sub-layer 206, an outer layer middle sub-layer (not shown), an outer layer inner sub-layer 208, or combinations thereof. The inner layer 170 can have an inner layer outer sub-layer 210, an inner layer middle sub-layer 212, an inner layer inner sub-layer 214, or combinations thereof. For example, the outer layer 174 can be a Nylon sheet laminated on one side with TPU and the inner layer 170 can be a Nylon sheet laminated on both sides with TPU.

The sub-layers can be TPU and/or Nylon, and/or other materials listed herein or combinations thereof. For example, the outer layer outer sub-layer 206 can be Nylon. The outer layer inner sub-layer 208 can be TPU. The inner layer outer sub-layer 210 can be TPU. The inner layer middle sub-layer 212 can be Nylon. The inner layer inner sub-layer 214 can be TPU. The inner layer 170, for example the inner layer inner sub-layer 214 can be non-porous and/or leak-proof. When the bag wall 166 is manufactured into the bag 154, the inner layer inner sub-layer 214 can be exposed to and in direct contact and fluid communication with the reservoir (as shown for illustrative purposes).

The outer layer inner sub-layer 208 can be made from a material that can be that can be bondable, meltable, adherable, weldable, or combinations thereof, with the material of the inner layer outer sub-layer 210.

As shown by arrows, the outer layer 174 can be placed against and contact the inner layer 170. The outer layer inner sub-layer 208 can be placed against and contact the inner layer outer sub-layer 210.

Figure 31C:
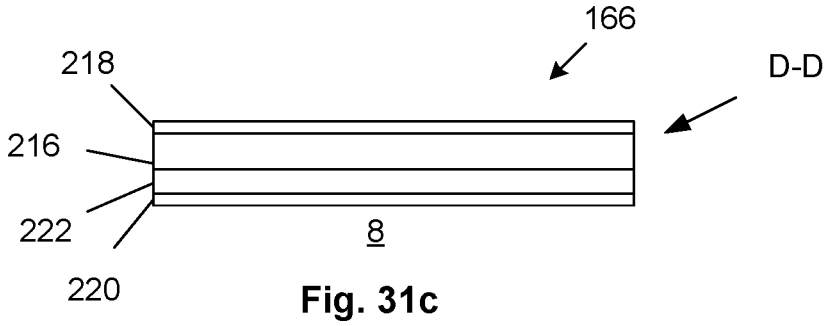
FIG. 31*c* is a variation of cross-section D-D during a method of manufacturing the bag wall of FIG. 31*a*.

FIG. 31*c* illustrates that the outer layer 174 can be bonded, merged, adhered, welded, melted, or otherwise integrated or combinations thereof, to the inner layer 170, forming a single integrated layer of the bag wall 166. For example, heat and/or compressive pressure can be applied to the outer and inner layers 170. The outer layer inner sub-layer 208 can be bonded, welded or melted with the inner layer outer sub-layer 210. For example, the outer layer inner sub-layer 208 and the inner layer outer sub-layer 210 can be TPU, and can weld together into a uniform homogenous or heterogeneous bonded sub-layer 216. The bonded sub-layer 216 can be any of the materials listed herein or combinations thereof, such as TPU.

The outer sub-layer 218 of the bag wall 166 can be the outer layer sub-layer. The inner sub-layer 220 of the bag wall 166 can be the inner layer inner sub-layer 214. The inner middle sub-layer 222 of the bag wall 166 can be the inner layer middle sub-layer 212. The bonded sub-layer 216 or outer middle sub-layer can be the combined outer layer inner sub-layer 208 and the inner layer outer sub-layer 210. (The reservoir is shown for illustrative purposes only. The reservoir will not yet be formed by a single open sheet of the bag wall 166.)

Figure 32A:
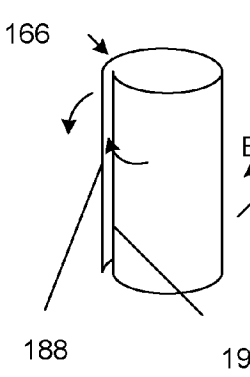
FIG. 32*a* is a perspective view of a method of manipulating the bag wall during manufacturing of the bag from the bag wall.
Figure 32A:
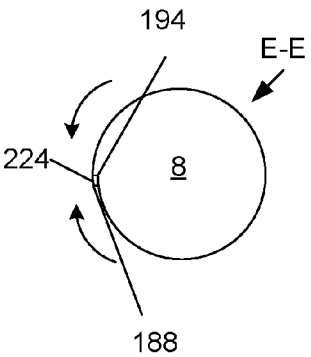

FIGS. 32*a* and 32*a*' illustrate that the bag wall 166 can be rotated or curled, as shown by arrows, to form a cylindrical or near-cylindrical configuration. The bag wall 166 on the radial inside of the left lateral edge 188 adjacent to the left lateral edge 188 can be bonded to the bag wall 166 on the radial outside of the right lateral edge 194 adjacent to the right lateral edge 194, for example at a bond or weld zone 224.

Figure 32B:
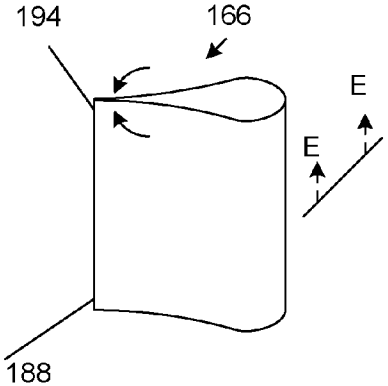
FIG. 32*b* is a perspective view of a method of manipulating the bag wall during manufacturing of the bag from the bag wall.
Figure 32B:
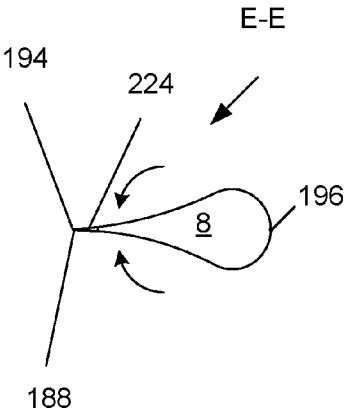

FIGS. 32*b* and 32*b*' illustrate that the bag wall 166 can be rotated and formed, as shown by arrows, around a fold line 196 (shown for illustrative purposes in FIG. 10*b*') to form a configuration with a constant or variable cross-section of a tear drop or droplet. The bag wall 166 on the radial inside (i.e., on the reservoir side of the bag wall 166) of the left lateral edge 188 adjacent to the left lateral edge 188 can be bonded to the bag wall 166 on the radial inside of the right lateral edge 194 adjacent to the right lateral edge 194, for example at a bond or weld zone 224.

Figure 33A:
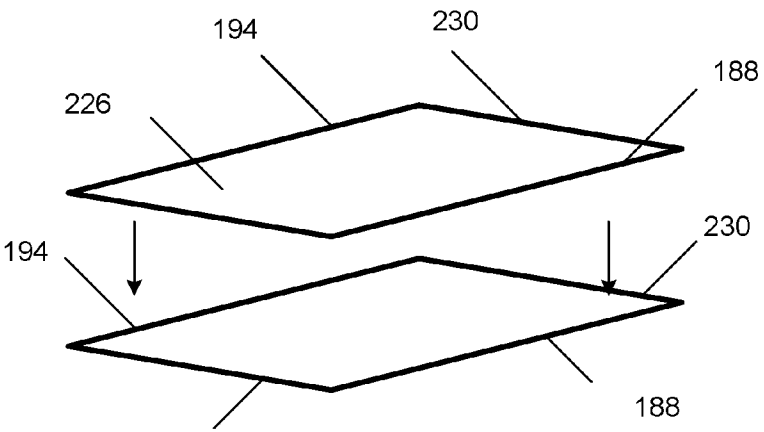
FIGS. 33*a* and 33*b* illustrate a variation of a method for manufacturing the bag.

FIG. 33*a* illustrates that a first bag wall panel 226 can be aligned and oriented with a second bag wall panel 228. The lateral and bottom edges 230 of the first bag wall panel 226 can be brought into contact with the lateral and bottom edges 230 of the second bag wall panel 228, as shown by arrows.

Figure 33B:
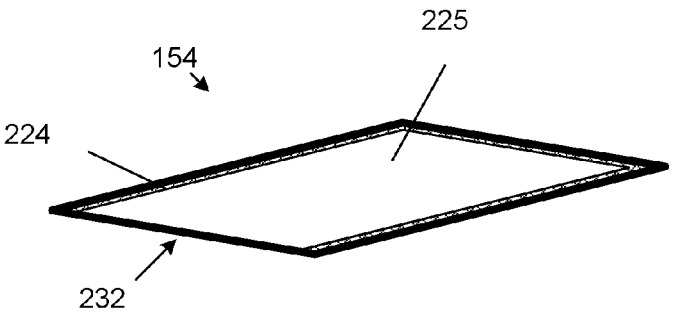

FIG. 33*b* illustrates that the areas of the first bag wall panel 226 and the second bag wall panels 228 around the left lateral edge 188, right lateral edge 194, and bottom edge 230 can be a weld zone 224 that can be bonded to each other. Part or all of the length of the top of the panels can be unbonded, for example, forming an openable mouth 232 through which a user can access the reservoir (e.g., to deliver or remove fluids).

Figure 34A:
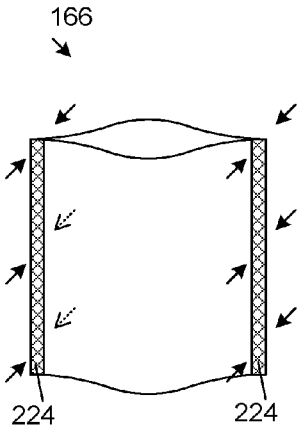
FIGS. 34*a* and 34*b* illustrate variations of a method for manufacturing the bag.

FIG. 34*a* illustrates that the front and rear sides of the bag wall 166, such as the configurations of the bag walls 166 formed as shown in FIGS. 32*a* through 32*b*', can be bonded or welded to each other, as shown by arrows. The bonding can be along the full height of the left and/or right lateral edges 194 and the area adjacent to the edges, as shown by the weld zones 224.

Figure 34B:
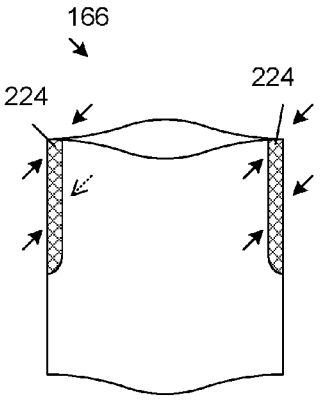

FIG. 34*b* illustrates that the front and rear sides of the bag wall 166, such as the configurations of the bag walls 166 formed as shown in FIGS. 32*a* through 32*b*', can be bonded or welded to each other, as shown by arrows. The bonding can be along a part of the height, such as from the top of the bag wall 166 to about half-way down the bag wall 166, of the left and/or right lateral edges 194 and the area adjacent to the edges, as shown by the weld zones 224.

Figure 35:
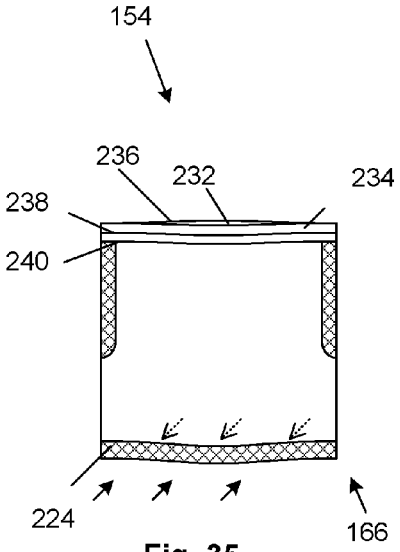
FIG. 35 illustrates a variation of a method for manufacturing the bag.

FIG. 35 illustrates that the front and rear sides of the bag wall 166, such as the configurations of the bag walls 166 formed as shown in FIG. 34*a* or 34*b*, can be bonded or welded to each other, as shown by arrows, along part or the full width of the bottom of the bag wall 166, as shown by the weld zone 224.

The bag 154 can have a mouth reinforcement 234 formed or added to the front and back along all or part of the width of the top of the bag wall 166. The mouth reinforcement 234 can have a lip 236 at the top distal end of the bag 154 and/or the mouth reinforcement 234. The lip 236 can be around the perimeter of the mouth 232. The mouth reinforcement 234 can have a catch 238 and/or a guide 240. The catch 238 and/or guide 240 can be configured to slidably receive or otherwise releasably attach with the slider 204. The catches and/or guides can extend laterally from the front and/or back of the bag 154.

Figure 36:
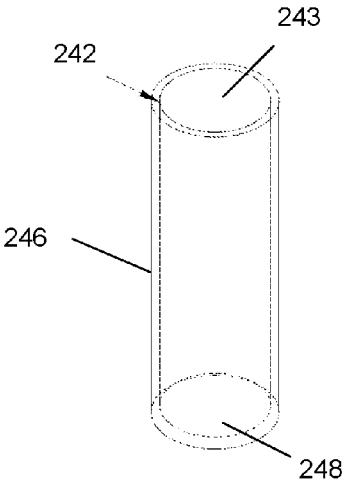
FIG. 36 is a front perspective view of a variation of an assembled cylindrical bag and/or sleeve.
Figure 37:
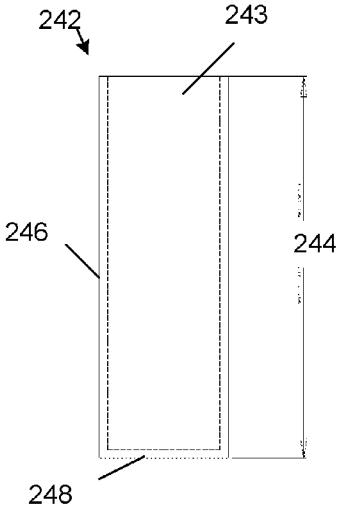
FIG. 37 is a front view of a variation of an assembled cylindrical bag and/or sleeve.

FIGS. 36 and 37 illustrate that the sleeve 242 can have a cylindrical configuration with an open top. For example, a cylindrical sleeve 242 can be slid onto the reservoir shown in FIG. 24*a*. The sleeve 242 can alternately be configured, for example to fit the bag 154 shown in FIG. 23*a*.

The sleeve 242 can have a sleeve height 244. The sleeve height 244 can be any of the ranges or examples disclosed for the bag wall height 200.

The sleeve side 246 can be made from a first panel 62 (e.g., the construction of the bag wall 166 is shown as a single panel). The sleeve bottom 248 can be made from a second panel. The sleeve side 246 can be attached or integrated with the sleeve bottom 248, for example by adhesives, welding (e.g., RF welding), molding, stamping, or combinations thereof.

The reservoir volume inside of the bag 154 can be from about 0.15 L to about 20 L for example about 0.5 L, 1.5 L, 2.0 L, or 3 L.

The bag 154 can have an R-value (thermal resistance) from about 0.18 $m^2$·K/(W·in.) to about 2 $m^2$·K/(W·in.), more narrowly from about 0.75 $m^2$·K/(W·in.) to about 2 $m^2$·K/(W·in.) or 1.76 $m^2$·K/(W·in.), for example about 1.01 $m^2$·K/(W·in.).

FIGS. 38*a* through 38*c* illustrate that the container 2 can have a rigid container top 4, a rigid bottom cup 10 or container bottom 92 (shown through the see-through bag wall 166 to extend up into the hollow reservoir), and a flexible reservoir and bag wall 166.

The container 2 can have a cap 164. The cap 164 can be rotatably attached to and removable from the container top 4. The cap 164 can detachably cover and seal a top port 44 and/or nozzle 6. The cap 164 can snap 274 or screw onto the container top 4. The cap 164 can have a smaller diameter than the container top 4.

FIG. 38*b* illustrates that the container 2 can have a flexible, length-adjustable, and removable handle 12 attached to the container top 4 and the container bottom 92 as described herein. FIG. 38*c* illustrates that the container 2 can have a rigid handle 12 fixedly or removable attached to, or integrated with, the container top 4 and container bottom 92.

Information such as text and/or figure logos, instructions, volume size, safety information, or combinations thereof can be printed, stamped, embossed, or combinations thereof, onto any elements, such as the "Hydrapak" logo shown on the bag wall 166 and the container top 4.

FIGS. 39*a* and 39*b* illustrate that the container 2 can be longitudinally contracted, such as by being longitudinally compressed. The container top 4 and container bottom 92 can be pressed together, for example while twisting or counter-rotating the container top 4 with respect to the container bottom 92. The reservoir and bag wall 166 can collapse and crumple and/or fold inside of the container top 4 and/or container bottom 92. The container top 4 can releasably snap 274-fit and/or screw-fit to the container bottom 92.

FIG. 39*a* illustrates that the container 2 can have no handle 12 or that the handle 12 (e.g., as shown in FIGS. 38*b* and/or 38*c*) can be removed from the remainder of the container 2 before, during or after the container 2 is longitudinally contracted.

The element labeled as the bag wall 166 in FIGS. 39*a* and 39*b* can be the end of the bag wall 166 or can instead be the top of the container bottom 92 (in which case the bag wall 166 would be wholly contained within the container top 4 and the container bottom 92.

Figure 40A:
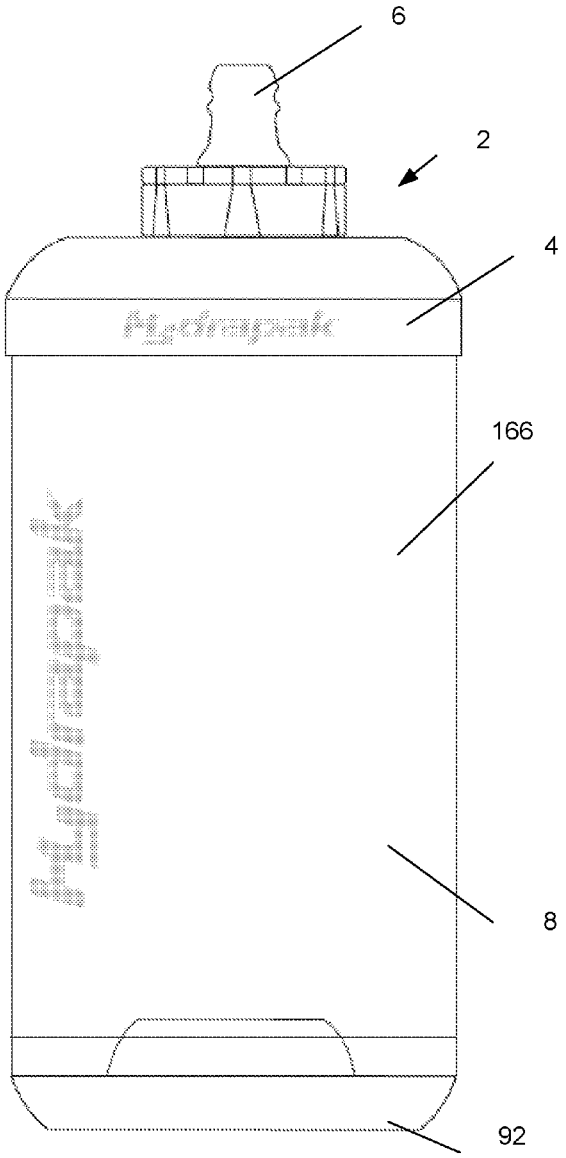
FIGS. 40*a* and 40*b* illustrate expanded and contracted variations of a variation of the container. The reservoir is shown as see-through in FIG. 40*a*.
Figure 40B:
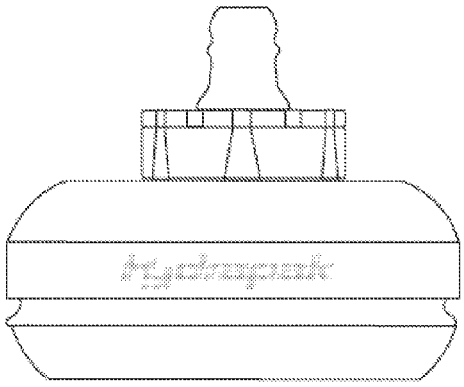

FIGS. 40*a* and 40*b* illustrate that the container 2 can have a nozzle 6 or nipple extending from the container top 4 and no cap 164.

Figure 41A:
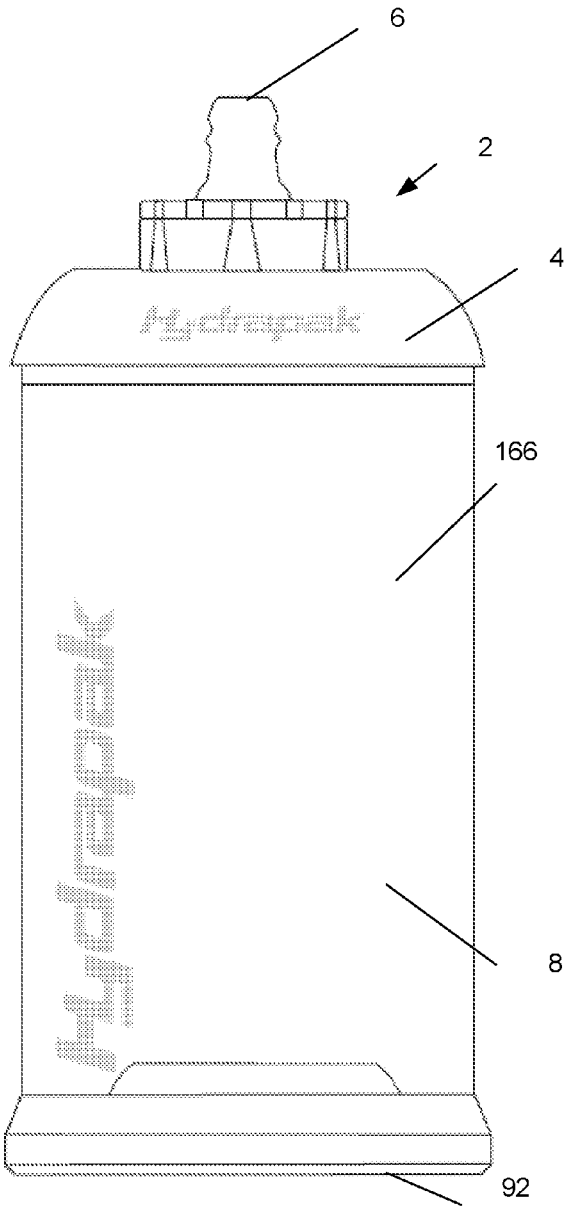
FIGS. 41*a* and 41*b* illustrate expanded and contracted variations of a variation of the container. The reservoir is shown as see-through in FIG. 41*a*.
Figure 41B:
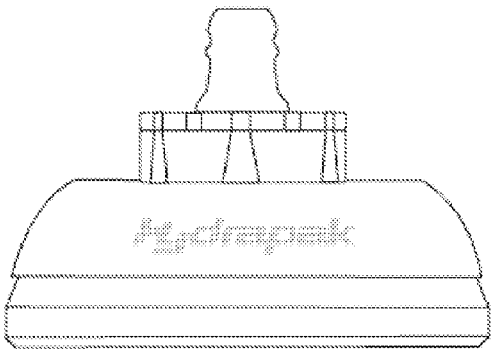

FIGS. 41*a* and 41*b* illustrate that the container 2 can have a widened bottom of the container 2 base. For example, the widest location of the container 2 can be the bottom of the container bottom 92.

Figure 42A:
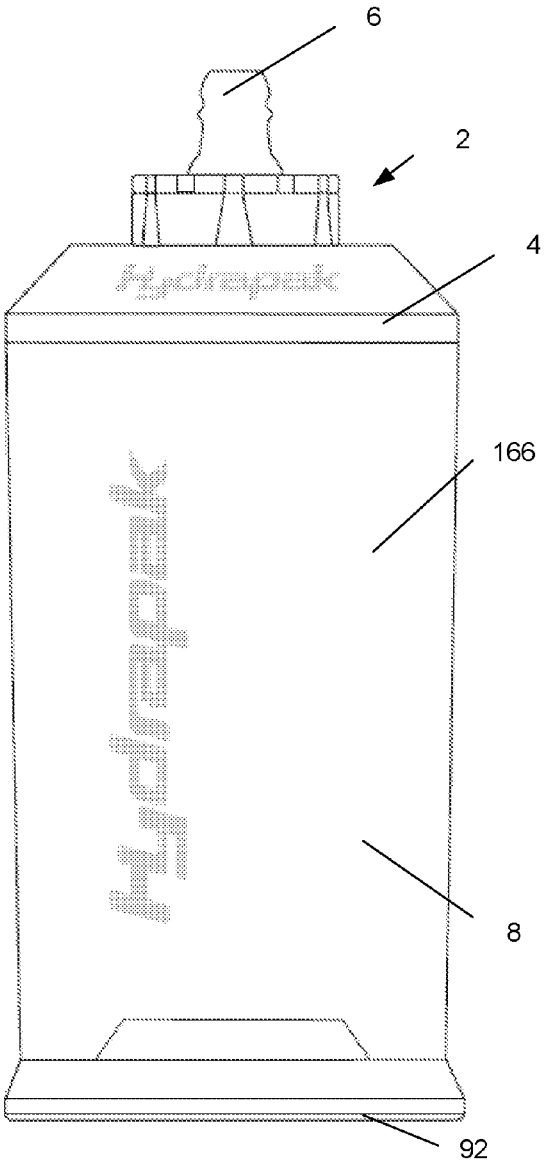
FIGS. 42*a* and 42*b* illustrate expanded and contracted variations of a variation of the container. The reservoir is shown as see-through in FIG. 42*a*.
Figure 42B:
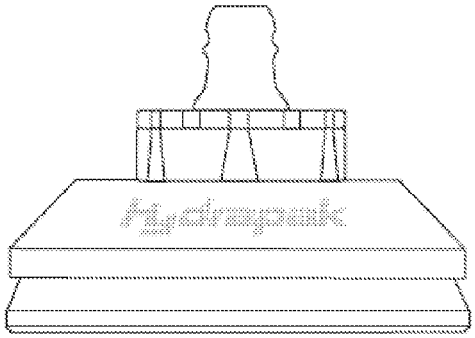

FIGS. 42*a* and 42*b* illustrate that the top of the container top 4 can have a sharp angled top (unlike the rounded container top 4 shown in FIGS. 41*a* and 41*b*, for example).

Figure 43A:
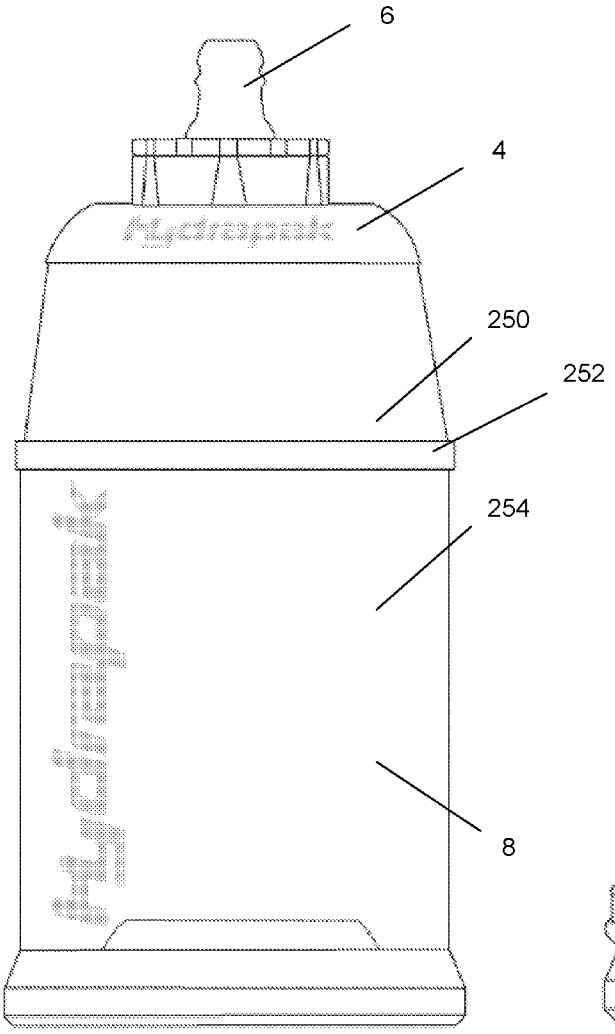
FIGS. 43*a* and 43*b* illustrate expanded and contracted variations of a variation of the container. The reservoir is shown as see-through in FIG. 43*a*.
Figure 43B:
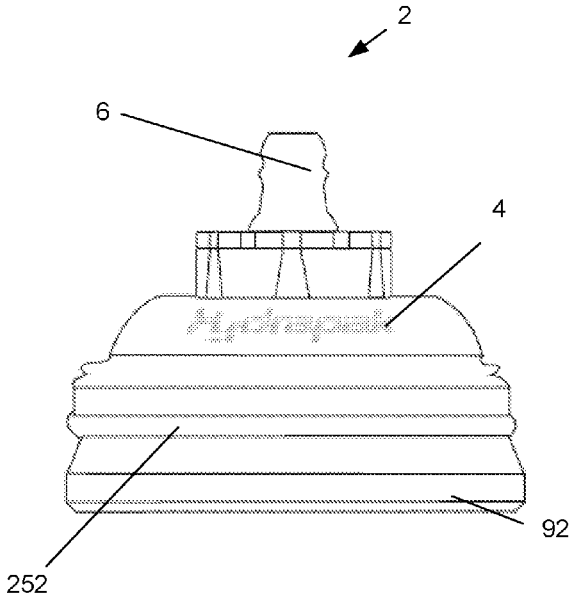

FIGS. 43*a* and 43*b* illustrate that the reservoir can be radially surrounded by a flexible or rigid upper bag wall 250, a rigid intermediate ring 252, and a flexible or rigid lower bag wall 254. The upper and/or lower bag walls can crumple and/or fold inside of the container top 4, intermediate ring 252 and container bottom 92 when the container 2 is longitudinally compressed or contracted. The intermediate ring 252 can removably snap 274 and/or screw fit to the container top 4 and/or container bottom 92, and/or the container top 4 can attach directly to the container bottom 92.

Figure 44A:
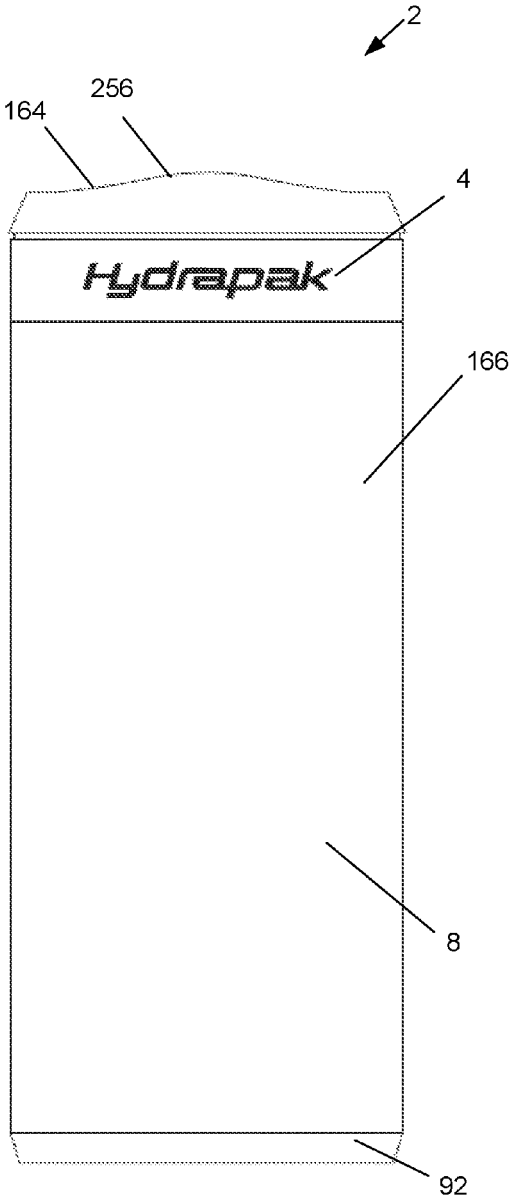
FIGS. 44*a* and 44*b* are side and top views of a variation of the container.
Figure 44B:
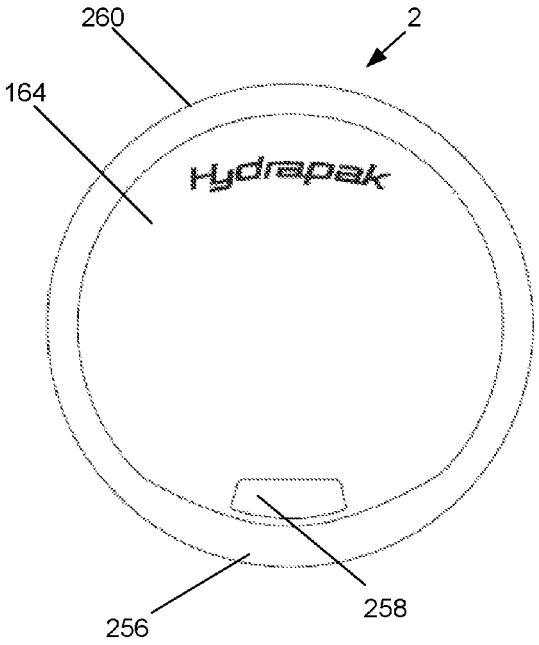

FIGS. 44*a* and 44*b* illustrate that the cap 164 or lid can be rotatable attached to the container top 4. The cap 164 can have the same diameter as the entirety of, or the top terminus of the container top 4. The cap 164 can have an elevated cap rim 260 around the perimeter of the top of the cap 164. The cap 164 can have one or more drinking ports 258 for accessing the fluid of the reservoir. The cap 164 can have a second drinking port 258 or vacuum release port 44 positioned away from a primary drinking port 258. The drinking ports 258 can be in fluid communication with the reservoir. The cap 164 rim can be elevated and/or thickened at a rim elevation 256 adjacent to the drinking port 258.

Figure 45A:
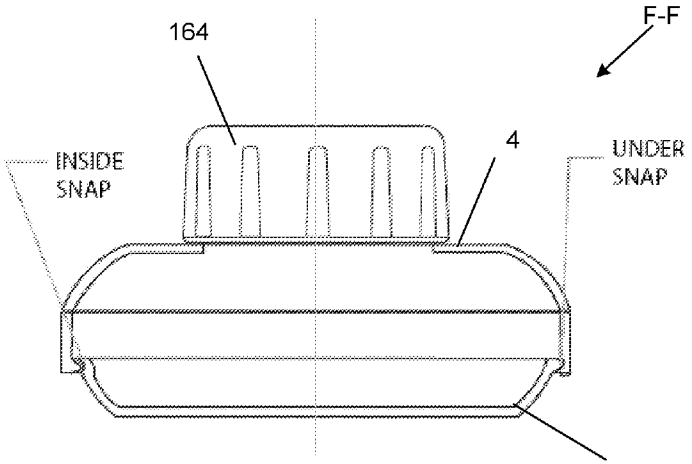
FIGS. 45*a* through 45*d* illustrate variations of cross-section F-F of FIG. 39*b*. The bag walls are not shown for illustrative purposes. The cap in FIGS. 45*a* through 45*c* is not shown in cross-section.

FIG. 45*a* illustrates that the container bottom 92 can have a radially inside snap 262. The container top 4 can have an under snap 264. The under snap 264 can releasably snap fit with the inside snap 262.

Figure 45B:
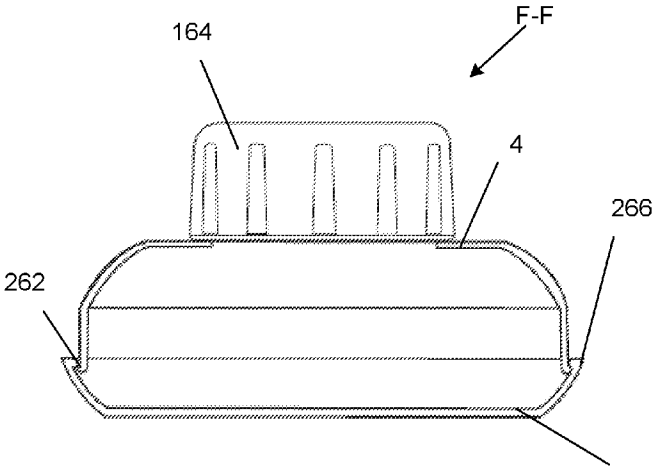

FIG. 45*b* illustrates that the container top 4 can have an inside snap 262. The container bottom 92 can have an over snap 266. The over snap 266 can releasably snap 274 fit with the over snap 266.

Figure 45C:
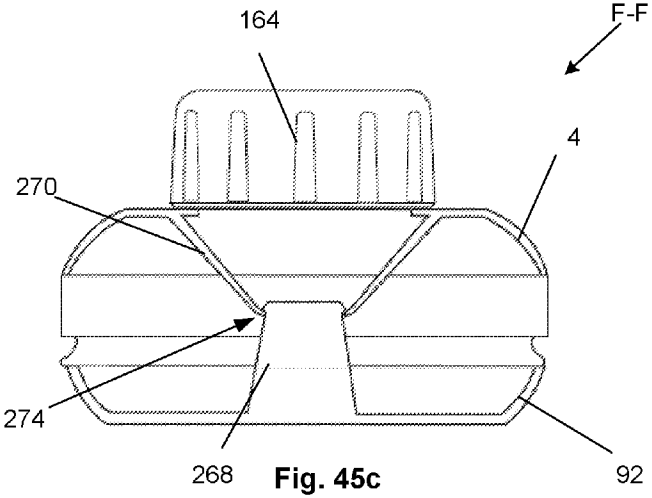

FIG. 45*c* illustrates that the container bottom 92 can have a snap hub 268. The snap hub 268 can be a cylindrical, conical or partially conical configuration elevating from the base of the container bottom 92. The container top 4 can have a snap cone 270 or snap arms 272. The snap cone 270 or arms can descend from the top or sides of the container top 4. A releasable snap 274 can be formed where the snap cone 270 or arms fit against the snap hub 268 when the container 2 is in a longitudinally contracted or compressed configuration. The snap hub 268 can have one or more indentations or a circumferentially indented ring configured to receive the terminal end or ends of the snap cone 270 or arms.

Figure 45D:
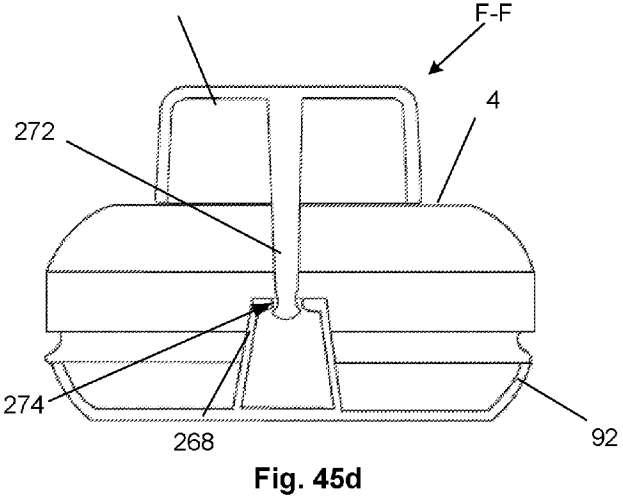

FIG. 45*d* illustrates that the snap hub 268 can have a central port 44 configured to releasably attach to a snap arm 272. The central port 44 can be at the top and radial center of the snap hub 268. The snap arm 272 can be integral with or fixedly attached to the cap 164.

It is apparent to one skilled in the art that various changes and modifications can be made to this disclosure, and equivalents employed, without departing from the spirit and scope of the invention. Elements of systems, devices and methods shown with any embodiment are exemplary for the specific embodiment and can be used in combination or otherwise on other embodiments within this disclosure.

We claim:

1. A flexible container device comprising:

a rigid container top; and a flexible reservoir panel having a first layer, a second layer and a third layer, wherein at least a portion of the flexible reservoir panel forms a side and a bottom of the flexible container device, wherein the flexible reservoir panel has a first end and a second end opposite the first end, wherein the second end forms at least a portion of the bottom of the flexible container device, wherein the first end is attached to the rigid container top, wherein at least a portion of the second end has a seam, wherein the flexible reservoir panel has a cross-sectional dimension that tapers from a first dimension to a second dimension less than first dimension, wherein the second dimension is closer to the seam than the first dimension, wherein the second layer has a lower density than the first layer and/or the third layer, wherein at least a portion of the second layer is positioned between the first layer and the third layer, and wherein the flexible reservoir panel is collapsible.

2. The device of claim 1, wherein the rigid container top comprises a polyurethane section having a hardness from about 92 shore-A durometer to about 97 shore-A durometer and wherein the flexible reservoir panel is attached to the rigid container top at the polyurethane section.

3. The device of claim 1, further comprising a cap removeably attached to the rigid container top, wherein the cap comprises a bite nozzle configured to prevent fluid flow through the bite nozzle when in a closed configuration.

4. A flexible container device comprising:

a rigid container top;

a rigid container bottom;

a flexible reservoir panel having a first open end and a second open end, wherein the flexible reservoir panel is attached at the first open end to the rigid container top, and wherein the flexible reservoir panel is attached at the second open end to the rigid container bottom, and wherein the flexible reservoir panel is collapsible and is attached to itself at a seam, wherein the rigid container top and the rigid container bottom have a hardness from about 1.20 times to about 1.03 times the hardness of the flexible reservoir panel; and a rigid intermediate ring attached to the flexible reservoir panel, wherein the rigid container top is configured to releasably couple to the rigid container bottom when the rigid intermediate ring snaps or fits into the rigid container bottom.

5. The device of claim 1, further comprising a rigid container bottom having a hardness from about 90 shore-A durometer to about 100 shore-A durometer.

6. The device of claim 1, wherein the flexible reservoir panel has a hardness from about 83 shore-A durometer to about 87 shore-A durometer.

7. The device of claim 1, wherein the seam is welded by a lap weld.

8. The device of claim 4, wherein the rigid container top comprises a polyurethane section having a hardness from about 92 shore-A durometer to about 97 shore-A durometer and wherein the flexible reservoir panel is attached to the rigid container top at the polyurethane section.

9. The device of claim 4, further comprising a cap removably attached to the rigid container top, wherein the cap comprises a bite nozzle configured to prevent fluid flow through the bite nozzle when in a closed configuration.

10. A flexible container device comprising:

a rigid container top;

a rigid container bottom;

a flexible reservoir panel having a first open end and a second open end, wherein the flexible reservoir panel is attached at the first open end to the rigid container top, and wherein the flexible reservoir panel is attached at the second open end to the rigid container bottom, and wherein the flexible reservoir panel is collapsible and is attached to itself at a seam, wherein the rigid container top and the rigid container bottom have a hardness from about 1.20 times to about 1.03 times the hardness of the flexible reservoir panel;

a rigid intermediate ring attached to the flexible reservoir panel, wherein the rigid container top is configured to releasably couple to the rigid container bottom when the rigid intermediate ring snaps or fits into the rigid container bottom; and a cap removably attached to the rigid container top, wherein the cap comprises a bite nozzle configured to prevent fluid flow through the bit nozzle when in a closed configuration.

11. The device of claim 4, wherein the rigid container bottom has a hardness from about 90 shore-A durometer to about 100 shore-A durometer.

12. The device of claim 10, further comprising:

a handle extending from at least one of the rigid container top and the rigid container bottom, wherein the handle is not attached to the flexible reservoir panel.

13. The device of claim 12, wherein the handle is integrated with the rigid container top.

14. The device of claim 12, wherein the handle is flexible and length adjustable.

15. The device of claim 12, wherein the rigid container top comprises a polyurethane section having a hardness from about 92 shore-A durometer to about 97 shore-A durometer and wherein the flexible reservoir panel is attached to the rigid container top at the polyurethane section.

16. The device of claim 1, wherein the seam comprises a weld or a gusset, wherein the second layer comprises an insulative material, and wherein the rigid container top has a hardness from about 1.20 times to about 1.03 times the hardness of the flexible reservoir panel.

17. The device of claim 16, wherein the second layer is attached to the first layer and/or the third layer, and wherein at least a portion of one, two, or three edges of the flexible reservoir wall have a weld zone.

18. The device of claim 17, wherein the first layer and/or the third layer comprise a thermoplastic polyurethane material.

19. The device of claim 18, wherein the rigid container top is configured to releasably couple to the second end of the flexible reservoir panel when the flexible container device is in a collapsed configuration.

20. The device of claim 19, wherein the second end of the flexible reservoir panel comprises a snap hub and the rigid container top comprises a snap arm, wherein the snap arm is configured to releasably snap fit against the snap hub when the flexible container device is in the collapsed configuration.

* * * * *